US008442419B2

(12) United States Patent
Ikeda et al.

(10) Patent No.: US 8,442,419 B2
(45) Date of Patent: May 14, 2013

(54) IMAGE FORMING APPARATUS AND METHOD FOR CONTROLLING SAME

(75) Inventors: Yoshimichi Ikeda, Numazu (JP); Takao Kume, Yokohama (JP); Hitoshi Furukawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 12/486,522

(22) Filed: Jun. 17, 2009

(65) Prior Publication Data

US 2009/0317148 A1 Dec. 24, 2009

(30) Foreign Application Priority Data

Jun. 20, 2008 (JP) ..... 2008-162300

(51) Int. Cl.
*G03G 15/00* (2006.01)

(52) U.S. Cl.
USPC ..... 399/167; 399/75; 399/76

(58) Field of Classification Search ..... 399/75, 399/76, 53, 167
See application file for complete search history.

(56) References Cited

U.S. PATENT DOCUMENTS

| | | | | |
|---|---|---|---|---|
| 7,013,102 | B2 * | 3/2006 | Ehara | 399/167 |
| 7,239,829 | B2 * | 7/2007 | Tanaka | 399/167 |
| 2003/0016965 | A1 * | 1/2003 | Matsumoto | 399/167 |
| 2004/0161263 | A1 | 8/2004 | Ehara | |
| 2007/0075658 | A1 * | 4/2007 | Ishikawa | 318/85 |
| 2007/0110477 | A1 * | 5/2007 | Handa et al. | 399/167 |

FOREIGN PATENT DOCUMENTS

JP 2004-233952 8/2004

* cited by examiner

*Primary Examiner* — Walter L Lindsay, Jr.
*Assistant Examiner* — Roy Y Yi
(74) *Attorney, Agent, or Firm* — Canon USA Inc IP Division

(57) ABSTRACT

In full-color printing, one of first and second rotary members is activated with a time lag after the other of the first and second rotary members is activated such that the phase difference between the first and second rotary members is an adjusted phase difference. In addition, every time monochrome printing is performed, the time lag is changed.

10 Claims, 20 Drawing Sheets

| | POWER-ON | INITIALIZATION | | STAND-BY | COLOR PRINTING | | STAND-BY |
|---|---|---|---|---|---|---|---|
| | | ACTIVATION | DEACTIVATION | | ACTIVATION | DEACTIVATION | |
| Kcnt | 0 | 0→1 | 1 | 1 | 1→2 | 2 | 2 |
| Ccnt | 1 | 1→2 | 2 | 2 | 2→0 | 0 | 0 |

| FIG. 11A |
| --- |
| FIG. 11B |

FIG. 13

| Ccnt | Kcnt | PHASE DIFFERENCE (degrees) |
|---|---|---|
| 0 | 0 | 0 |
| 1 | 1 | 0 |
| 2 | 2 | 0 |
| 0 | 1 | 120 |
| 1 | 2 | 120 |
| 2 | 0 | 120 |
| 0 | 2 | 240 |
| 1 | 0 | 240 |
| 2 | 1 | 240 |

FIG. 14

| | POWER-ON | MONOCHOROME PRINTING | | STAND-BY | COLOR PRINTING | | STAND-BY |
|---|---|---|---|---|---|---|---|
| | | ACTIVATION | DEACTIVATION | | ACTIVATION | DEACTIVATION | |
| Kcnt | 2 | 2→0 | 0 | 0 | 0→1 | 1 | 1 |
| Ccnt | 0 | 0 | 0 | 0 | 0→1 | 1 | 1 |

| | POWER-ON | COLOR PRINTING | | STAND-BY | COLOR PRINTING | | STAND-BY |
|---|---|---|---|---|---|---|---|
| | | ACTIVATION | DEACTIVATION | | ACTIVATION | DEACTIVATION | |
| Ccnt | 0 | 0→1 | 1 | 1 | 1→2 | 2 | 2 |
| Kcnt | 2 | 2→0 | 0 | 0 | 0→1 | 1 | 1 |

IMAGE FORMING APPARATUS AND METHOD FOR CONTROLLING SAME

BACKGROUND OF THE INVENTION

1. Field of the Invention

The present invention relates to an electrophotographic color image forming apparatus that includes a plurality of photosensitive members, such as a laser printer, a copier, and a facsimile machine.

2. Description of the Related Art

There exists a color image forming apparatus that uses a system of sequentially forming toner images of four colors (yellow (Y), magenta (M), cyan (C), and black (K)) on a single photosensitive member and sequentially transferring and superimposing the toner images on a transfer member (hereinafter referred to as 4-pass system). Image forming using the 4-pass system is disadvantageous in that it takes a long time to acquire a final color image.

With the increase in image forming speed, a color image forming apparatus using an in-line system of emitting light beams from a plurality of optical devices to individually scan a plurality of photosensitive members is becoming known.

The color image forming apparatus using the in-line system forms toner images corresponding to four colors on a plurality of photosensitive members using a plurality of developing units, superimposes the four color toner images on an intermediate transfer belt, and finally transfers the combined toner image to a sheet. Because this in-line image forming apparatus forms four color toner images at a time, the time required for acquiring a final color image can be shorter than that required in the image forming apparatus using the 4-pass system.

However, unlike the 4-pass image forming apparatus, because using a plurality of photosensitive members and a plurality of optical devices, the in-line image forming apparatus tends to have color shift of a periodically varying AC component resulting from decentering of a gear for driving each photosensitive member or unevenness of rotation of a motor. To address this AC-component color shift, there is a known measure to suppress relative color shift by adjusting the relationship between rotational phases of photosensitive drums corresponding to colors to a desired state. One such example is described in Japanese Patent Laid-Open No. 2004-233952 (hereinafter referred to as Patent Document 1).

Various ideas to address the AC-component color shift have been proposed.

For example, Patent Document 1 describes a technique of, in full-color mode, stopping a photosensitive member for use in color printing (hereinafter referred to as the color photosensitive member) and a photosensitive member for use in black printing (hereinafter referred to as the black photosensitive member) at a position different from the position where each of the photosensitive members starts its rotation while maintaining the relationship between the color and black photosensitive members at a phase relationship at which color shift is small.

With this technique, the engagement relationship between a gear for use in color printing and a gear for use in black printing is made different from a preceding one, and local degradation of the gears is reduced. The position at which each of the photosensitive members stops is also changed successively, and local degradation therein is also reduced. Patent Document 1 also describes that an advantage of preventing or effectively reducing color shift in a color image is obtainable because the photosensitive members are activated while a predetermined rotational phase relationship between the color and black photosensitive members is maintained.

In the technique described in Patent Document 1, the rotational phase relationship between the black and color photosensitive members is maintained at a constant state by stopping the black photosensitive member at the same position as the position at which its rotation starts in monochrome mode even if the mode is switched between the monochrome and full-color modes. Patent document 1 describes that this leads to an advantage of, even if an image is formed in black mode, preventing or effectively reducing color shift in a color image formed in subsequent printing in full-color mode.

However, the above image forming apparatus has problems described below.

First, if monochrome printing is repeatedly performed, the black photosensitive member stops at the same position as the preceding stop position again and again. This leads to local abrasion in the gear for the black photosensitive member.

In addition to the gear, contacts on the surface of the photosensitive member, including a blade of the photosensitive member and a developing roller, are always the same, so the photosensitive layer may also suffer from local abrasion. If the abrasion in the photosensitive layer becomes worse, the sensitivity to exposure becomes lost or it becomes impossible to uniformly charge the surface of the photosensitive member at a desired potential. This leads to difficulty in forming a high-quality image.

Second, because, in color mode, the color and black photosensitive members are activated at the same time, as described above, a large starting current is necessary. More specifically, a starting current for a motor for driving the color photosensitive member and that for a motor for driving the black photosensitive member overlap each other, so a large current must flow. This results in necessity of using a large capacity part in a power supply and other electrical components, so the cost is increased.

Even in the technique disclosed in Patent Document 1, if each of the color and black photosensitive members stops at a position different from the preceding stop position each time and both of the photosensitive members are activated separately, the above problems will be solved.

However, this approach will be unable to maintain the phase relationship between the color and black photosensitive members, so it will be difficult to retain the phase difference at a desired state on starting, which is an original aim of Patent Document 1.

Under the circumstances, it is to be desired that even if black mono-color printing is continuously performed local abrasion in a rotary member or a gear for driving the rotary member be reduced, an overlap between peaks of the starting currents of motors for driving rotary members be reduced, and the phase relationship between the rotary members become a desired one.

SUMMARY OF THE INVENTION

According to one aspect of the present invention, a color image forming apparatus includes a first rotary member, a second rotary member, a deactivation controller, and an activation controller. The first rotary member is configured to form a color toner image. The second rotary member is configured to form a black toner image. In black mono-color printing, an image is formed using the second rotary member without use of the first rotary member. In full-color printing, an image is formed using the first and second rotary members. A phase difference between the first and second rotary members is adjusted to reduce color shift. The deactivation controller is configured to stop the second rotary member at a position different from a preceding stop position when black mono-color printing is completed. The activation controller is configured to, in full-color printing, activate one of the first and second rotary members with a time lag after the other of the first and second rotary members is activated such that the phase difference between the first and second rotary members is an adjusted phase difference. The activation controller is configured to change the time lag in response to the phase difference between the first and second rotary members being changed by control on stopping of the second rotary member performed by the deactivation controller.

Further features of the present invention will become apparent from the following description of exemplary embodiments with reference to the attached drawings.

BRIEF DESCRIPTION OF THE DRAWINGS

FIG. 13 illustrates a relationship between phase counter values and a phase difference of photosensitive members according to one embodiment of the present invention.

FIG. 14 illustrates how a phase counter value is changed according to one embodiment of the present invention.

DESCRIPTION OF THE EMBODIMENTS

Preferred embodiments of the present invention will now be illustrated. The individual embodiments described below will be helpful in understanding a variety of concepts of the present invention from the generic to the more specific. Further, the technical scope of the present invention is defined by the claims, and is not limited by the following individual embodiments.

Exemplary embodiments of the present invention are illustratively described below with reference to the drawings. Elements described in the exemplary embodiments are provided for illustrative purpose only. The scope of the present invention is not limited to these elements.

Schematic Cross-Sectional View of Color Image Forming Apparatus

Figure 1:
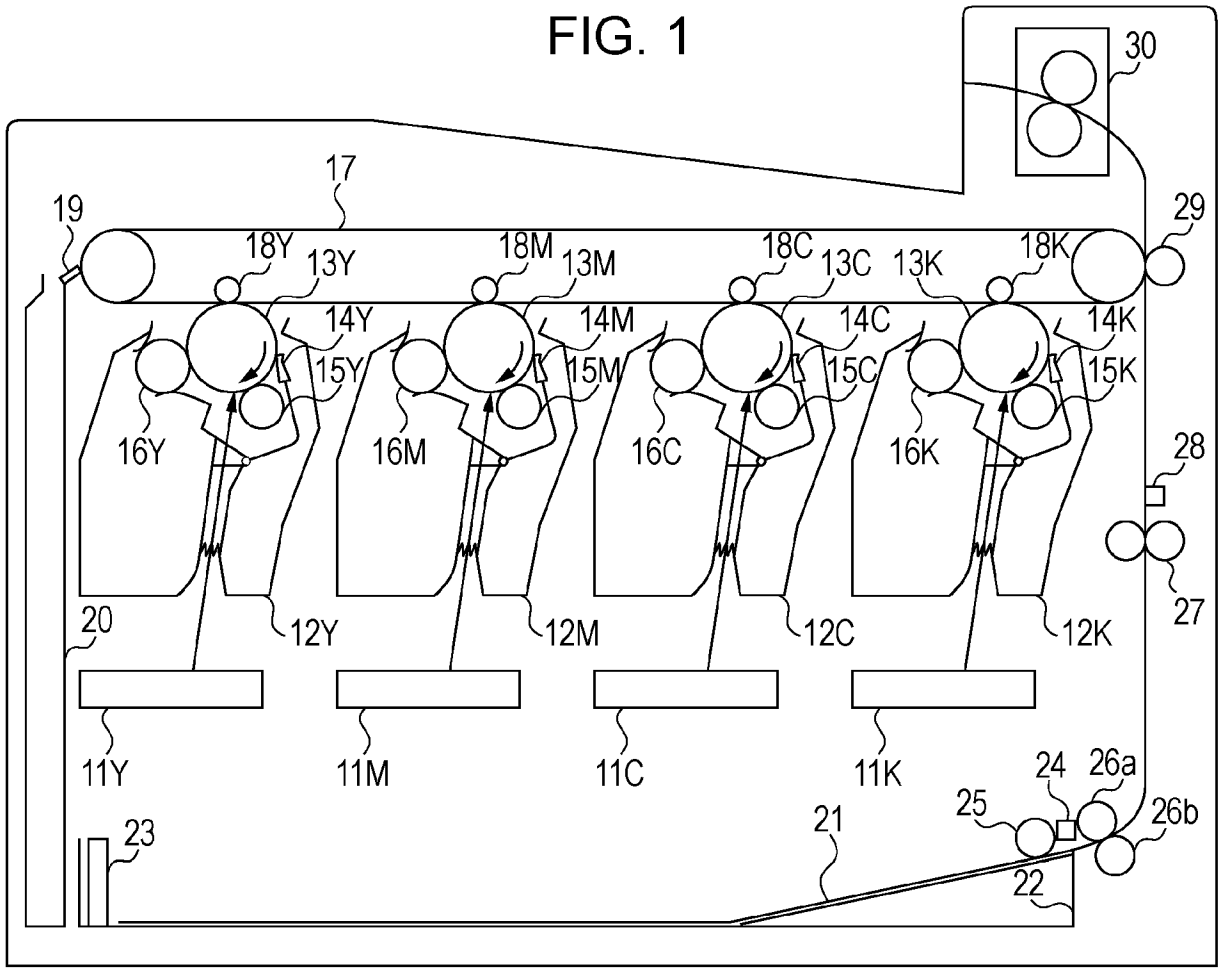
FIG. 1 illustrates an overall structure of a color image forming apparatus using an in-line system according to one embodiment of the present invention.

A first exemplary embodiment will be described as follows. FIG. 1 illustrates an overall structure of a color image forming apparatus using an in-line system as one example. With reference to this drawing, the structure of the image forming apparatus is described first.

The color image forming apparatus using an in-line system is configured to be capable of forming a color toner image and a black toner image. More specifically, the color image forming apparatus is configured to be capable of superimposing toner images of a plurality of colors, yellow (Y), magenta (M), cyan (C), and black (K), and outputting a full-color image.

To form an image of each color, the image forming apparatus includes laser scanners (11Y, 11M, 11C, and 11K) and cartridges (12Y, 12M, 12C, and 12K).

The cartridges (12Y, 12M, 12C, and 12K) include photosensitive members (13Y, 13M, 13C, and 13K) and photosensitive-member cleaners (14Y, 14M, 14C, and 14K), respectively. Each of the photosensitive members (13Y, 13M, 13C, and 13K) rotates in the direction of the arrow. The photosensitive-member cleaners (14Y, 14M, 14C, and 14K) are disposed in contact with the photosensitive members (13Y, 13M, 13C, and 13K), respectively. For example, a blade can be used in the photosensitive-member cleaners (14Y, 14M, 14C, and 14K). The cartridges (12Y, 12M, 12C, and 12K) also include charging rollers (15Y, 15M, 15C, and 15K) and developing rollers (16Y, 16M, 16C, and 16K), respectively.

The photosensitive members (13Y, 13M, 13C, and 13K) are disposed in contact with an intermediate transfer belt 17. The intermediate transfer belt 17 can be separated from the photosensitive members (13Y, 13M, 13C, and 13K). The photosensitive members (13Y, 13M, 13C, and 13K) face primary transfer rollers (18Y, 18M, 18C, and 18K), respectively, such that the intermediate transfer belt 17 is sandwiched therebetween. The intermediate transfer belt 17 is provided with a belt cleaner 19 and a waste-toner container 20. The waste-toner container 20 is disposed to collect cleared waste toner.

A cassette 22 for storing sheets 21 is provided with a size guide 23 for regulating the position of the sheets 21 in the cassette 22 and a sheet sensor 24 for detecting the presence or absence of a sheet 21 in the cassette 22. A sheet feed roller 25, separation rollers 26*a* and 26*b*, and a registration roller 27 are disposed along a conveying path of the sheet 21. A registration sensor 28 is disposed downstream of the registration roller 27 in a conveying direction in which the sheets 21 are conveyed. A secondary transfer roller 29 is disposed in contact with the intermediate transfer belt 17. A fixing unit 30 is disposed downstream of the secondary transfer roller 29.

An electrophotographic process will now be described. The surfaces of the photosensitive members (13Y, 13M, 13C, and 13K) are uniformly charged by the charging rollers (15Y, 15M, 15C, and 15K), respectively, in the dark place inside the cartridges (12Y, 12M, 12C, and 12K).

Then, the surfaces of the photosensitive members (13Y, 13M, 13C, and 13K) are radiated with laser beams that are emitted from the laser scanners (11Y, 11M, 11C, and 11K) and that are modulated in accordance with image data. The charges in the regions radiated with the laser beams are removed, and an electrostatic latent image is thus formed on the surface of each of the photosensitive members (13Y, 13M, 13C, and 13K).

The developing rollers (16Y, 16M, 16C, and 16K) attach charged toners to the electrostatic latent images, and a toner image corresponding to each color is thus formed on the surface of each of the photosensitive members (13Y, 13M, 13C, and 13K). The toner images formed on the surfaces of the photosensitive members (13Y, 13M, 13C, and 13K) are sequentially transferred to the intermediate transfer belt 17 by the primary transfer rollers (18Y, 18M, 18C, and 18K) so as to be superimposed.

The sheet or sheets 21 stored in the cassette 22 are conveyed through the sheet feed roller 25. If a plurality of sheets 21 are conveyed, one sheet 21 is separated from the other by the separation rollers 26*a* and 26*b* and the sheet 21 is conveyed to the registration roller 27. The toner images on the intermediate transfer belt 17 are transferred by the secondary transfer roller 29 to the sheet 21 conveyed by the registration roller 27. At the last step, the toner images on the sheet 21 are fixed by the fixing unit 30, and the sheet 21 is ejected to the outside of the image forming apparatus.

Configuration Relating to Driving Photosensitive Member

Figure 2:
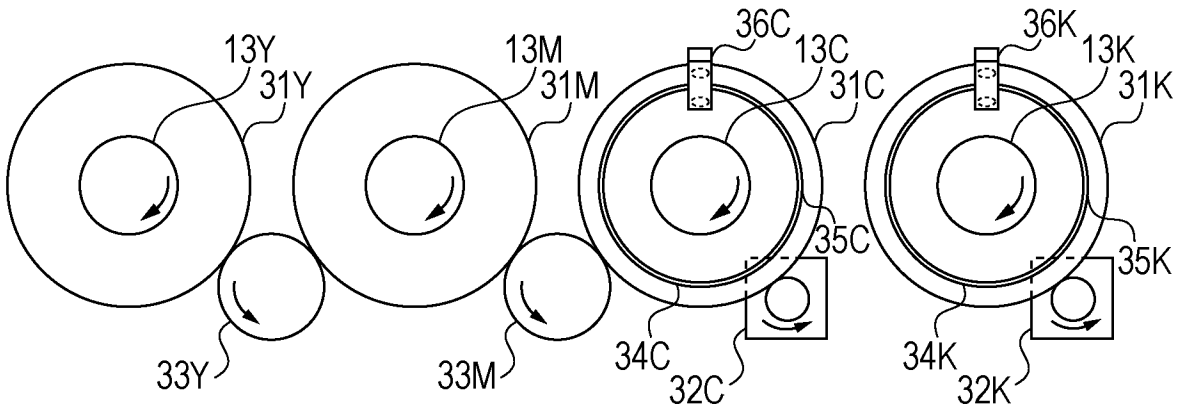
FIG. 2 illustrates a configuration of a driving unit for photosensitive members according to one embodiment of the present invention.

One example of a configuration relating to driving a photosensitive member will now be described with reference to FIGS. 2 and 3. In FIG. 2, the photosensitive members (13Y, 13M, 13C, and 13K) are connected to photosensitive-member gears (31Y, 31M, 31C, and 31K), respectively, by a coupling (not shown) such that they always have the same phase.

The photosensitive-member gear 31K for black is connected to a motor 32K for black. Similarly, the photosensitive-member gear 31C for cyan is connected to a motor 32C for cyan. The photosensitive-member gear 31M for magenta is connected to the photosensitive-member gear 31C for cyan through an intermediate gear 33M. The photosensitive-member gear 31Y for yellow is connected to the magenta photosensitive-member gear 31M through an intermediate gear 33Y.

Accordingly, the motor 32C for cyan drives the photosensitive member 13C for cyan, the photosensitive member 13M for magenta, and the photosensitive member 13Y for yellow. The photosensitive-member gear 31C for cyan, the photosensitive-member gear 31M for magenta, and the photosensitive-member gear 31Y for yellow are disposed so as to have a desired rotational phase relationship at which relative color shift is reduced.

Configuring the photosensitive members as described above and adjusting the phase relationship between the photosensitive member 13K for black and the photosensitive member 13C for cyan enables the photosensitive members to have a relationship at which color shift is reduced. In the following description, in adjusting the phase of each of the photosensitive members (13Y, 13M, 13C, and 13K), it is assumed that the phase relationship between the photosensitive member 13C and the photosensitive member 13K is adjusted. To make a distinction among photosensitive members serving as rotary members, the rotary members are sometimes referred to a first rotary member, a second rotary member, . . . , an n-th rotary member. A group of rotary members is also referred to a first rotary member or a second rotary member.

Description of Method for Detecting Phase

Figure 3A:
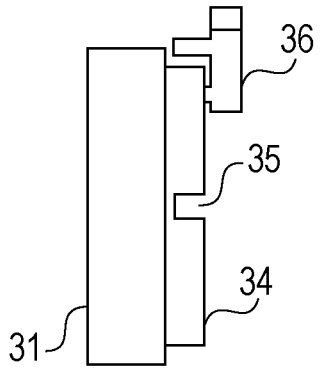
FIGS. 3A and 3B illustrate a configuration of a gear and a phase detection sensor for a photosensitive member according to one embodiment of the present invention.
Figure 3B:
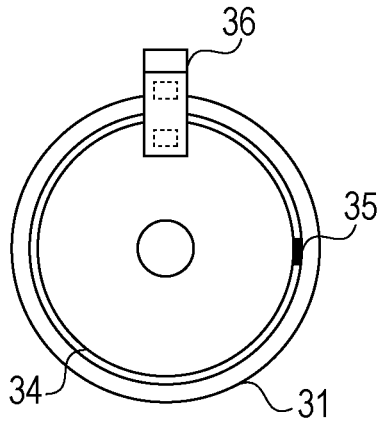

A method for detecting a phase of each of the photosensitive-member gear 31K for black and the photosensitive-member gear 31C for cyan will now be described with reference to FIGS. 2 and 3. FIGS. 3A and 3B illustrate the photosensitive-member gear 31K for black and the photosensitive-member gear 31C for cyan viewed from two directions. FIG. 3A is an illustration viewed from the side; FIG. 3B is an illustration viewed from the front.

The photosensitive-member gear 31K for black and the photosensitive-member gear 31C for cyan are provided with slit plates 34K and 34C, respectively.

The slit plates 34K and 34C have slits 35K and 35C, respectively. Phase detection sensors 36K and 36C each including a light-emitting portion and a light-detecting portion detect the slits 35K and 35C, respectively. In response to the detection, a phase signal is output, so the phase relationship between the photosensitive members 13K and 13C can be detected (identified).

When the photosensitive-member gears 31K and 31C are produced using the same mold, the positional relationship between the direction of decentering of the photosensitive-member gear 31K and the slit 35K and the positional relationship between that of the photosensitive-member gear 31C and the slit 35C are substantially the same. Accordingly, the phase relationship between the slit 35K and the photosensitive-member gear 31K and that between the slit 35C and the photosensitive-member gear 31C, that is, the phase relationship between the slit 35K and the photosensitive member 13K and that between the slit 35C and the photosensitive member 13C are substantially the same.

Figure 4:
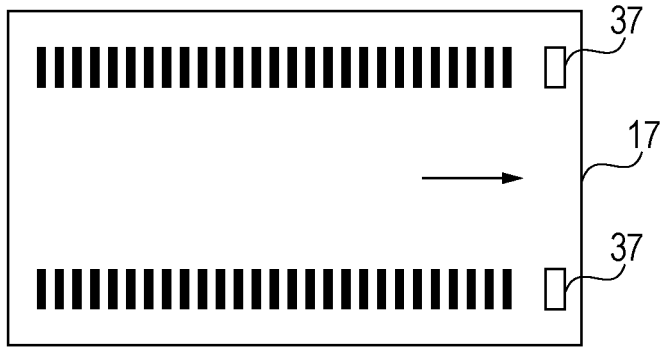
FIG. 4 illustrates a pattern for use in detecting a phase relationship between photosensitive members according to one embodiment of the present invention.

When the photosensitive-member gears 31K and 31C are produced using a plurality of molds, as illustrated in FIG. 4, a pattern having traces formed at the same time interval on the photosensitive member is transferred to the intermediate transfer belt 17, and the pattern is read by a pattern detection sensor 37. The phase relationship between the slit 35K and the photosensitive member 13K and that between the slit 35C and the photosensitive member 13C can be identified by calculation of a cumulative fluctuation component (average shift) of the distance between the traces of the read pattern.

In the following description, it is assumed that the photosensitive-member gears 31K and 31C are produced using the same mold, that is, the phase relationship between the slit 35K and the photosensitive member 13K and that between the slit 35C and the photosensitive member 13C are substantially the same.

Block Diagram of Control Configuration

Figures 5, 6:
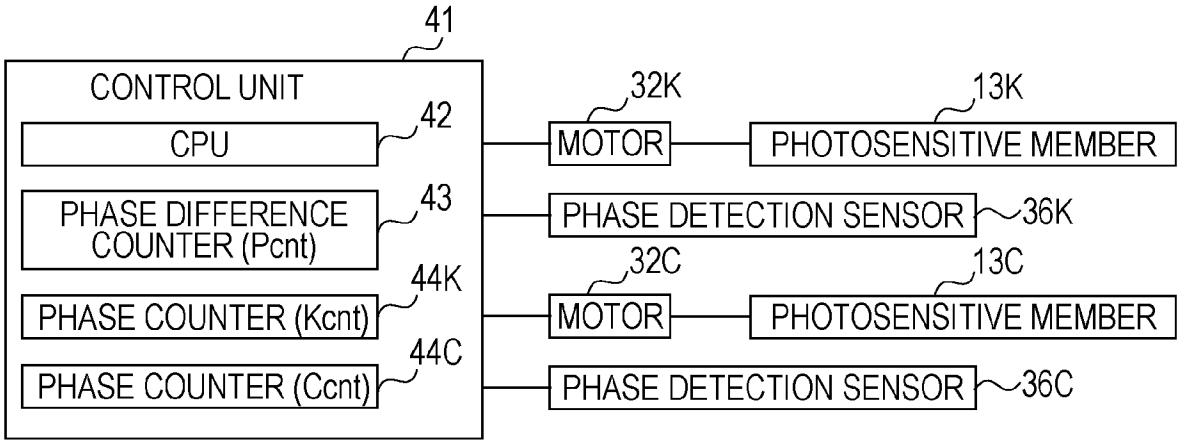
FIG. 5 is a block diagram of a control configuration according to one embodiment of the present invention.
FIG. 6 illustrates how a phase counter value is changed according to one embodiment of the present invention.

FIG. 5 illustrates a block diagram of a control unit 41 performing various kinds of control included in the image forming apparatus and a connection relationship between the control unit 41 and peripheral units.

The control unit 41 includes a central processing unit (CPU) 42, a phase difference counter 43, a phase counter 44C, and a phase counter 44K. The control unit 41 is connected to the motor 32C for driving the photosensitive member 13C, the motor 32K for driving the photosensitive member 13K, the phase detection sensor 36C, and the phase detection sensor 36K.

Activation, deactivation, and rotation speed of the motor 32C for driving the photosensitive member 13C and of the motor 32K for driving the photosensitive member 13K are controlled in response to a drive control signal according to control of the control unit 41.

At this time, to determine a drive control signal, an FG pulse signal indicating the rotation speed of each of the motor 32C and the motor 32K is transmitted to the control unit 41 from the motor.

The control unit 41 identifies the rotation speed of each motor in real time on the basis of the input FG pulse signal and determines a drive control signal for controlling various kinds of control.

The phase difference counter 43 counts the phase difference between the photosensitive members 13C and 13K, and more specifically, measures the interval between a pulse signal output from the phase detection sensor 36C and that from the phase detection sensor 36K. This measuring method may be achieved by counting the number of seconds or counting the number of pulses having a predetermined pulse width.

The phase counter 44C determines the time from detection of a pulse signal output from the phase detection sensor 36C to stopping of the motor 32C. Similarly, the phase counter 44K determines the time from detection of a pulse signal output from the phase detection sensor 36K to stopping of the motor 32K. The phase counters 44C and 44K are incremented every time the photosensitive members 13C and 13K are activated, respectively, and each counter returns to zero from two. The details will be provided in the description of a flowchart described below.

In the following, the description is provided assuming that the above-described block diagram illustrated in FIG. 5 performs processing mainly. However, the present exemplary embodiment is not limited to this assumption. For example, processing performed by the blocks other than the CPU 42 may be carried out in part or in entirety by the CPU 42. Alternatively, processing performed by the CPU 42 may be carried out in part or in entirety by an application-specific integrated circuit (ASIC).

Control for a photosensitive member serving as a rotary member according to a first exemplary embodiment will now be described below with reference to FIGS. 6 to 19.

Values of Phase Counters 44C and 44K in States

FIG. 6 illustrates an example of how the value of each of the phase counters 44C and 44K is changed in various states. FIG. 6 illustrates an example case where, as the initial value, Kcnt=0 and Ccnt=1 are set. However, other values, such as Kcnt=1 and Ccnt=2, can also be used. The phase counters 44C and 44K are sequentially updated by the execution of the process of a flowchart described below. The details thereof will be described below.

First, an initialization operation after power is turned on is described below with reference to FIGS. 6, 7, and 10.

Description of Activation Process in Initialization

Figure 7:
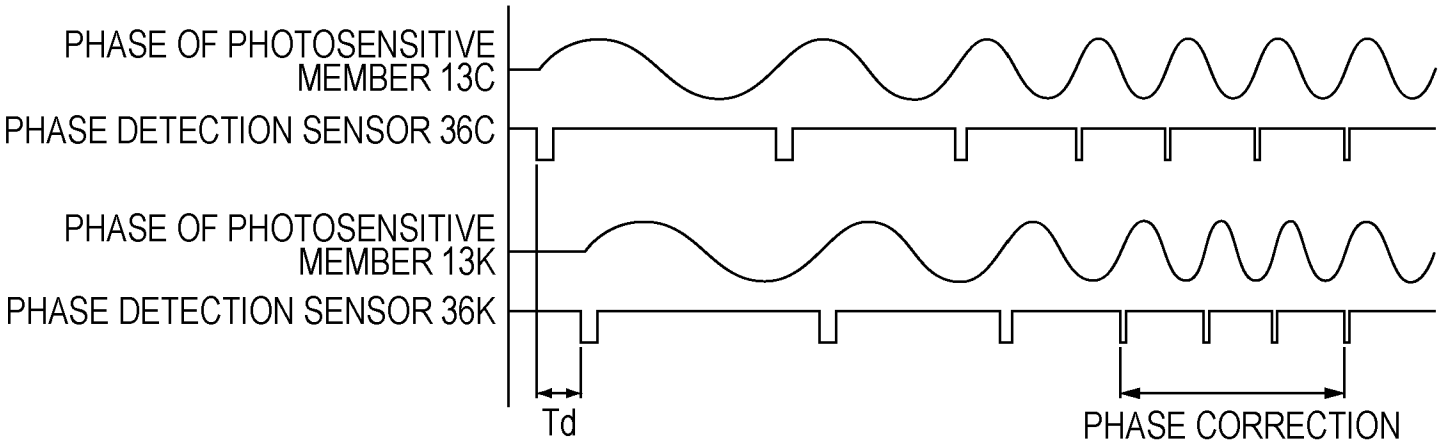
FIG. 7 illustrates how a phase relationship between photosensitive members is changed in an activation process in initialization according to one embodiment of the present invention.

FIG. 7 illustrates the phase of each of the photosensitive members 13C and 13K and the output of each of the phase detection sensors 36C and 36K in an activation process in initialization.

In the drawing, after the photosensitive member 13C is driven (in actuality, the photosensitive members 13C, 13Y, and 13M are simultaneously activated), a phase signal of the phase detection sensor 36C is output, and driving of the photosensitive member 13K starts after waiting a time interval corresponding to a delay value Td. After that, phase correction (also called phase adjustment) is performed, and the phase relationship between the photosensitive member 13C and the photosensitive member 13K is adjusted to a state at which there is no color shift.

Figure 10:
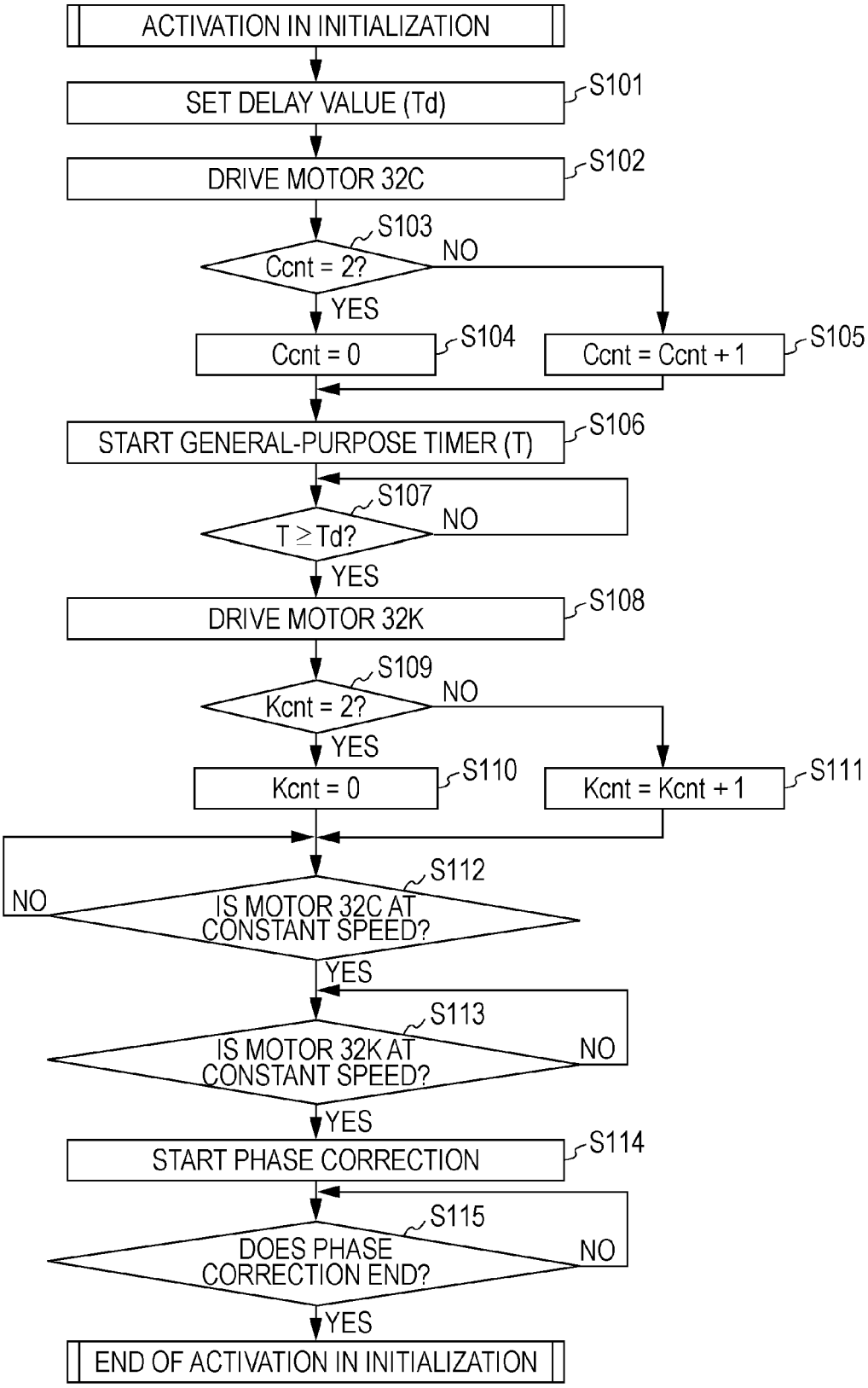
FIG. 10 is a flowchart of a process for activating photosensitive members in initialization according to one embodiment of the present invention.

FIG. 10 is a flowchart of an activation process in initialization. The steps of this flowchart are executed based on the processing of the control unit 41 illustrated in FIG. 5. The details are described below.

When the activation process in initialization starts, in step S101, the delay value Td is set. The delay value Td is the standby time of a second rotary member after a first rotary member is activated. The delay value Td sets the time lag between the activation of the photosensitive member 13C and that of the photosensitive member 13K. Here, the delay value Td is set at the value at which the starting current for the motor 32C for driving the photosensitive member 13C and that for driving the motor 32K for driving the photosensitive member 13K do not overlap. Substantially simultaneously with the setting in step S101, driving of the motor 32C for driving the photosensitive member 13C starts in step S102.

In steps S104 and S105, the counter value Ccnt is updated. More specifically, in step S103, when Ccnt=2 (YES in step S103), Ccnt becomes zero in step S104; when Ccnt≠2 (NO in step S103), Ccnt is incremented in step S105. In the previously described example illustrated in FIG. 6, because Ccnt=1, Ccnt is incremented and becomes two in step S105, and flow proceeds to step S106. The processing of steps S103 to S105 is also performed substantially simultaneously with the driving of the motor 32C in step S102.

Then, in step S106, a general-purpose timer T is started. In step S107, the value of the general-purpose timer T is compared with the delay value Td. When the value of the general-purpose timer T is equal to or larger than the delay value Td, flow proceeds to step S108. In step S108, driving of the motor 32K for driving the photosensitive member 13K having been waiting starts.

In steps S110 and S111, the counter value Kcnt is updated. More specifically, in step S109, when Kcnt=2, Kcnt becomes zero in step S110; when Kcnt≠2, Kcnt is incremented in step S111. Here in one example, because Kcnt=0, Kcnt is incremented and becomes one in step S111, and flow proceeds to step S112.

In step S112, it is determined whether the speed of the motor 32C for driving the photosensitive member 13C reaches a constant value and the motor 32C is in a steady rotation. In other words, it is determined whether the motor 32C (photosensitive member 13C) is driven at a constant speed. In the following, the description is provided using the phrase "driven at a constant speed," which has the same meaning as steady rotation.

In step S112, when it is determined that the motor 32C is driven at a constant speed (YES in step S112), flow proceeds to step S113, where it is determined whether the motor 32K for driving the photosensitive member 13K is driven at a constant speed.

When the motor 32K for driving the photosensitive member 13K is also driven at a constant speed (YES in step S113), phase correction of photosensitive members 13K and 13C starts in step S114. The phase correction is repeated until it is determined in step S115 that the phase difference between the photosensitive members 13K and 13C substantially reaches a target phase difference.

The details of the processing of step S115 are specifically described. The same description applies to phase correction (phase adjustment) performed after step S313 illustrated in FIG. 12 and that after step S616 illustrated in FIG. 24. The time difference between the output of the phase detection sensor 36K and the output of the phase detection sensor 36C is measured by the phase difference counter 43. When the detection of the phase difference between the photosensitive members 13C and 13K ends, either one of the outputs of the phase detection sensors 36 for the photosensitive members 13 is used as a reference. The motor 32 for driving the other one of the photosensitive members 13 is accelerated or decelerated such that the difference between the reference output and the output of the phase detection sensor 36 for the other photosensitive member 13 is substantially a target phase difference.

In the example illustrated in FIG. 7, the motor 32K for driving the photosensitive member 13K is accelerated such that the difference between the output of the phase detection sensor 36C for the photosensitive member 13C used as the reference and the output of the phase detection sensor 36K for the photosensitive member 13K is substantially a target phase difference (adjusted phase difference).

Being substantially a target phase difference indicates being a phase difference contained in a predetermined range when the phase difference between the photosensitive member 13K and the photosensitive member 13C is in a predetermined range. To make an adjustment more accurately, being strictly a phase difference having a certain angle may be targeted, instead of being substantially a target phase difference.

The phase correction is a publicly known technique in itself. The above-described form is merely an example, and other phase correction (phase adjustment) techniques are also applicable.

Referring back to the flowchart of FIG. 10, in step S115, it is determined whether the phase correction is completed. When it is completed (YES in step S115), the activation process in initialization is completed.

In the present exemplary embodiment, for the sake of enhancing understanding of the description, an example case is discussed where color shift is most reduced when there is no phase difference between the photosensitive members 13C and 13K. However, it is apparent for those skilled in the art to apply the present exemplary embodiment to other cases.

For example, the present exemplary embodiment is also applicable to a case where toner images having the same phase are transferred to the same position on the intermediate transfer belt 17 when a phase signal between the photosensitive members has a non-zero predetermined phase difference. In this case, after phase correction illustrated in FIG. 7, a phase signal between the photosensitive members has a predetermined phase difference, for example. The delay value Td, which will be described below, may be set at an appropriate value in consideration of a non-zero predetermined phase difference, the phase difference between the photosensitive members 13C and 13K during deactivation, and an accelerating curve of each of the photosensitive members.

Description of Deactivation Process in Initialization and Full-Color Printing

A deactivation process in initialization and full-color printing will now be described below with reference to FIGS. 8 and 11.

Figure 8:
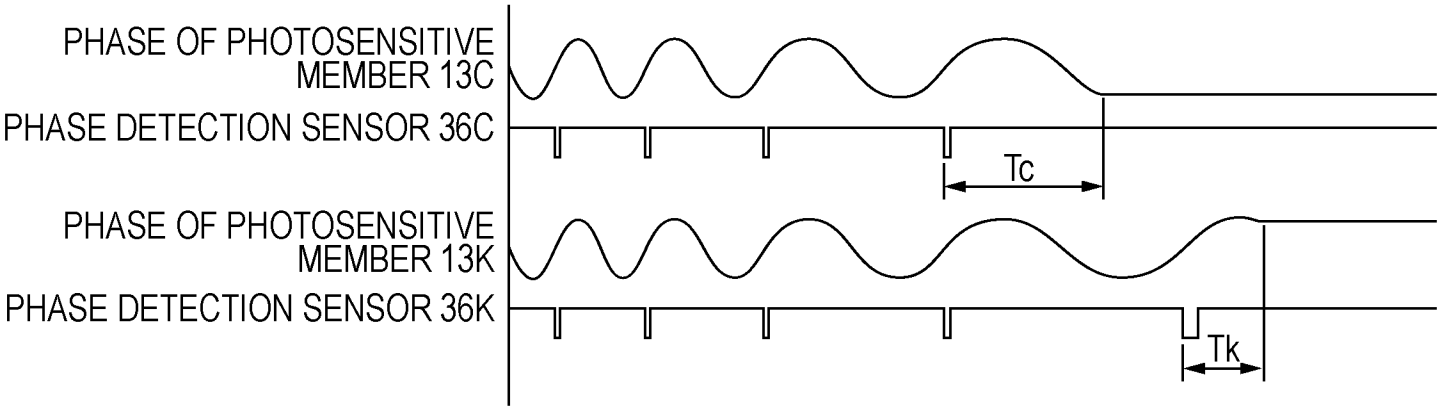
FIG. 8 illustrates how a phase relationship between photosensitive members is changed in a process for deactivating photosensitive members according to one embodiment of the present invention.

FIG. 8 illustrates the phase of each of the photosensitive member 13C serving as a first rotary member and the photosensitive member 13K serving as a second rotary member and the output of each of the phase detection sensors 36C and 36K therefor in a deactivation process in initialization and full-color printing. In FIG. 8, the photosensitive member 13C is at rest after waiting a time Tc from the detection of a corresponding phase, and the photosensitive member 13K is at rest after waiting a time Tk from the detection of a corresponding phase. The times Tc and Tk are described in detail with reference to the flowchart illustrated in FIG. 11, which will be described below.

Figures 11, 11A:
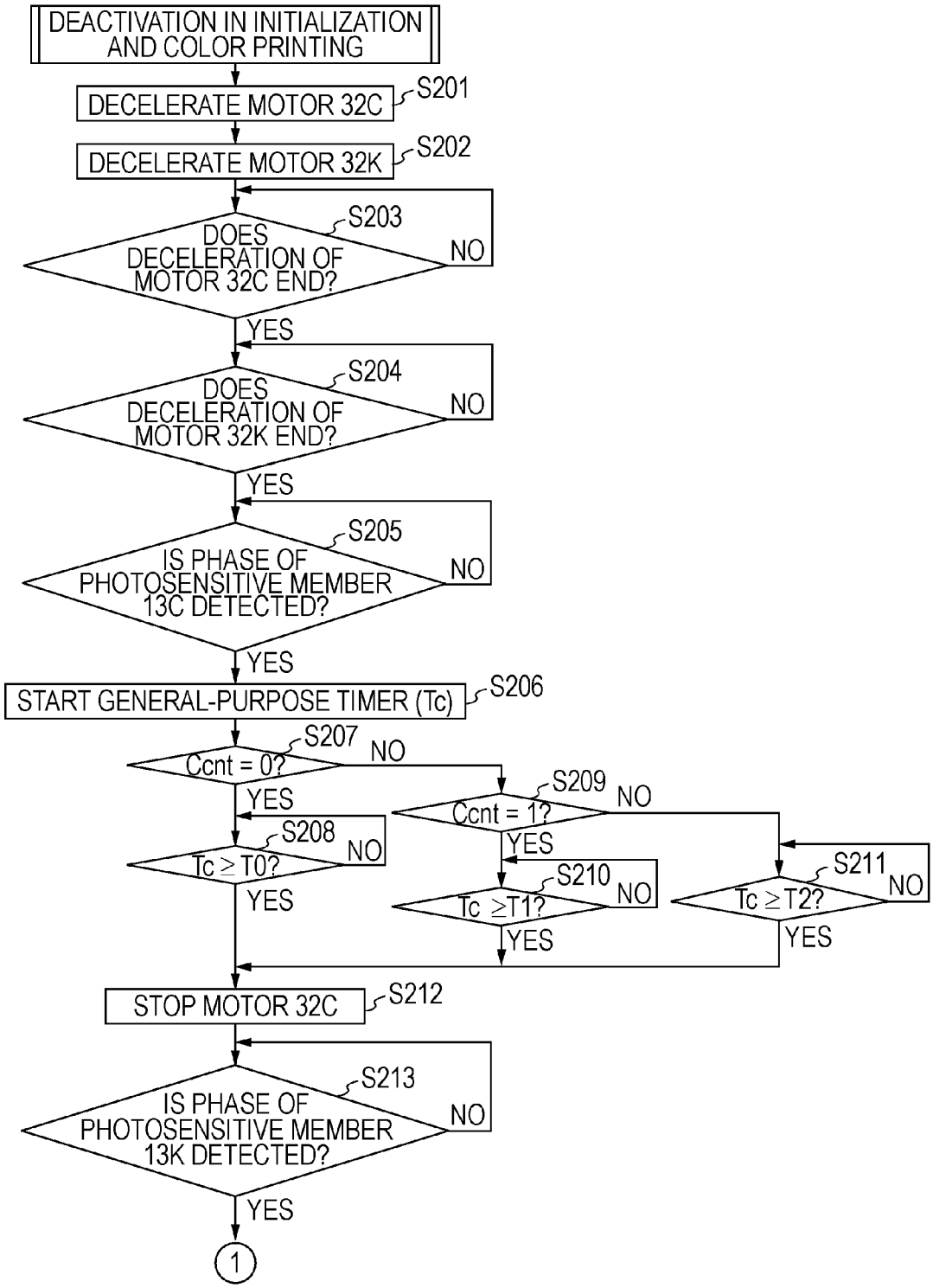
FIG. 11 is a flowchart of a process for deactivating photosensitive members in initialization and in full-color printing according to one embodiment of the present invention.
Figure 11B:
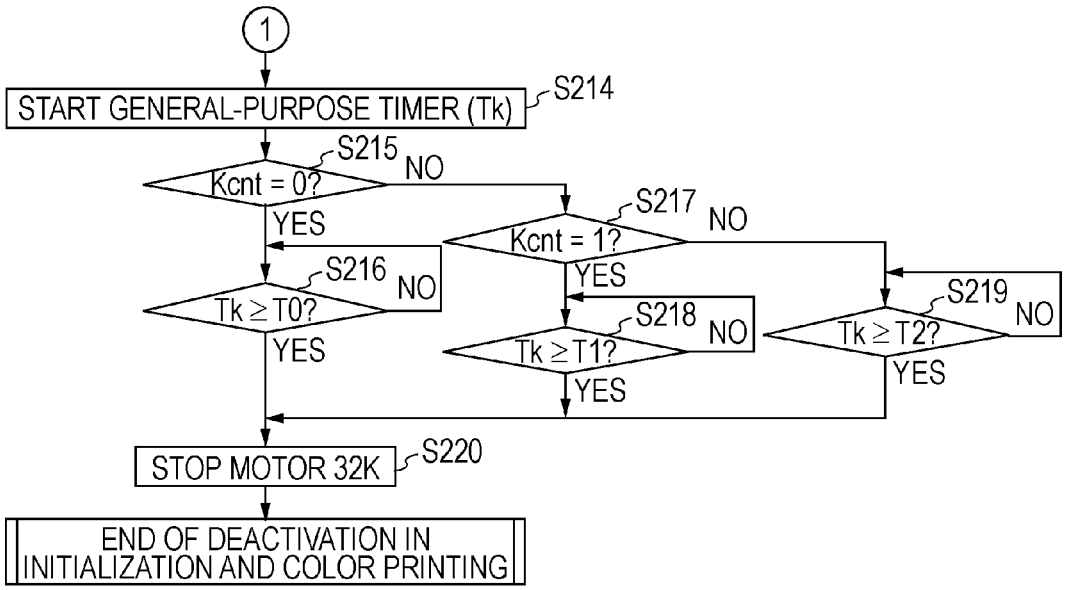

FIG. 11 is a flowchart of a deactivation process in initialization and full-color printing. The steps of this flowchart are executed based on the processing of the control unit 41 illustrated in FIG. 5. The details are described below.

When the deactivation process in initialization or full-color printing starts, in step S201, the motor 32C for driving the photosensitive member 13C is decelerated, and in step S202 the motor 32K for driving the photosensitive member 13K is decelerated.

Then, in step S203, the completion of the deceleration of the motor 32C for driving the photosensitive member 13C is determined, and in step S204, the completion of the deceleration of the motor 32K for driving photosensitive member 13K is determined. After that, flow proceeds to step S205.

In step S205, the phase signal of the photosensitive member 13C is detected. When the phase detection sensor 36C for the photosensitive member 13C detects the slit 35C, the general-purpose timer Tc is started in step S206.

In step S207, the value of the phase counter 44C is checked. When Ccnt=0, flow proceeds to step S208; when Ccnt≠0, flow proceeds to step S209. In step S209, when Ccnt=1, flow proceeds to step S210; when Ccnt≠1, flow proceeds to step S211.

In steps S208, S210, and S211, when the value of the general-purpose timer Tc is compared with predetermined values T0, T1, and T2, respectively. When Tc≧T0, Tc≧T1, and Tc≧T2 in steps S208, S210, and S211, respectively, the motor 32C for driving the photosensitive member 13C is stopped in step S212. T1 is the value at which the motor is stopped after a delay of a phase of 120 degrees with respect to T0. T2 is the value at which the motor is stopped after a delay of a phase of 240 degrees with respect to T0.

Examples of specific numerical values of T0 to T2 are provided below. For example, when 360 milliseconds is required for one rotation of the photosensitive member and T0 is a counter value corresponding to 120 ms, T1 is a counter value corresponding to 240 ms and T2 is a counter value corresponding to 360 ms.

Then, in step S213, the phase signal of the photosensitive member 13K is detected. When the phase detection sensor 36K for the photosensitive member 13K detects the slit 35K, the general-purpose timer Tk is started in step S214.

In step S215, the value of the phase counter 44K is checked. When Kcnt=0, flow proceeds to step S216; when Kcnt≠0, flow proceeds to step S217. In step S217, when Kcnt=1, flow proceeds to step S218; when Kcnt≠1, flow proceeds to step S219.

In steps S216, S218, and S219, when the value of the general-purpose timer Tk is compared with predetermined values T0, T1, and T2, respectively. T0, T1, and T2 used here are the same T0, T1, and T2 described above. When Tk≧T0, Tk≧T1, and Tk≧T2 in steps S216, S218, and S219, respectively, the motor 32K for driving the photosensitive member 13K is stopped in step S220. In the case where the flowchart of FIG. 11 indicates a deactivation process in color printing illustrated in FIG. 6, because Kcnt=2, the motor 32K for driving photosensitive member 13K is stopped through steps S217 and S218. In such a way, the deactivation process in initialization or full-color printing is completed, and the state shifts to a print stand-by state.

As described above, through steps S207 to S212 and steps S215 to S220, a plurality of stop positions can be provided. Accordingly, every time Ccnt or Kcnt is updated, the corresponding photosensitive member can stop at a position different from the preceding stop position.

The value of each of T0 to T2 is set such that the difference between the amount of movement for T1 waiting and that for T0 waiting, the difference between the amount of movement for T2 waiting and that for T1 waiting, and the difference between the amount of movement for T0 waiting and T2 waiting are the same. Accordingly, the phase relationship between the photosensitive members can be maintained constant. In the example illustrated in FIG. 11, three-level timer values using T0, T1, and T2 are described. However, the present exemplary embodiment is not limited to these values. Four-level or five-level timer values can also be used as long as the differential rotational angle resulting from the amount of movement in the rotary member at the this-time timer value and that at the preceding timer value is always at the same angle.

In such a way, with the flowchart illustrated in FIG. 11, each of the photosensitive members can be stopped at a position different from the preceding stop position while the phase difference between the photosensitive members can be maintained. Accordingly, the photosensitive member and the gear can be protected against local abrasion.

Activation Process in Full-color Printing

An operation in full-color printing will now be described below with reference to FIGS. 6, 9, 12, and 13.

Figure 9:
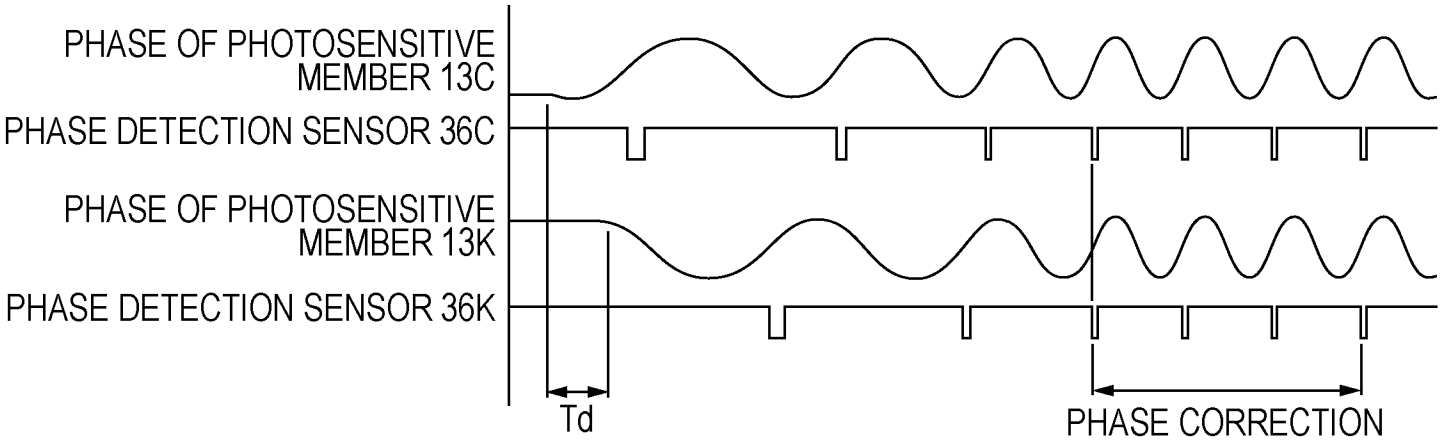
FIG. 9 illustrates how a phase relationship between photosensitive members is changed in an activation process in full-color printing according to one embodiment of the present invention.

FIG. 9 illustrates the phase of each of the photosensitive members 13C and 13K and the output of each of the phase detection sensors 36C and 36K therefor in an activation process in full-color printing. In FIG. 9, after waiting the time Td from the activation of the photosensitive member 13C, the photosensitive member 13K is activated.

Figure 12:
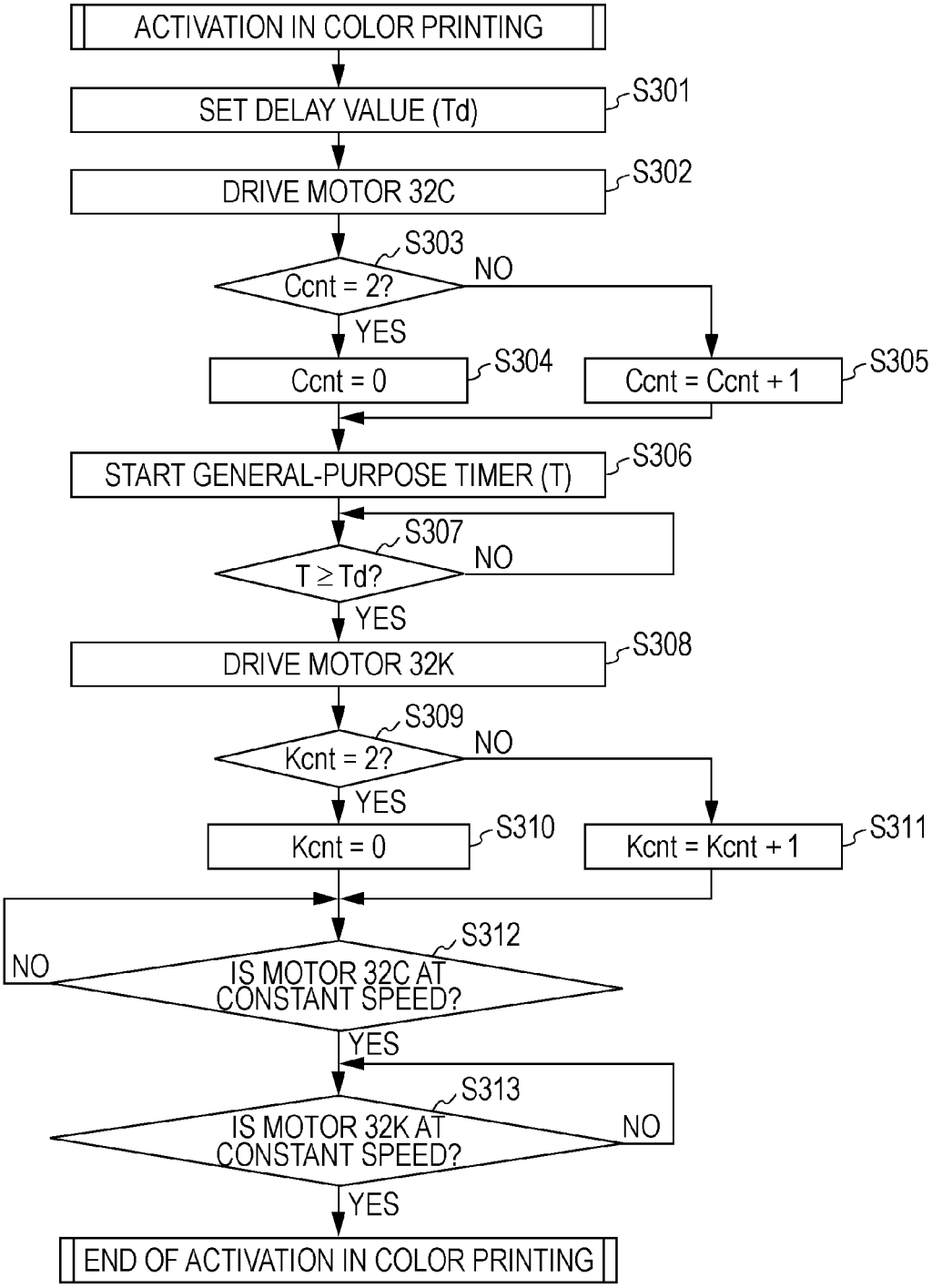
FIG. 12 is a flowchart of a process for activating photosensitive members in full-color printing according to one embodiment of the present invention.

FIG. 12 is a flowchart of an activation process in color printing. The steps of this flowchart are executed based on the processing of the control unit 41 illustrated in FIG. 5. The details are described below.

In FIG. 12, when the activation process in color printing starts, in step S301, the delay value Td is set. The delay value Td is a setting that indicates a delay time in activating the photosensitive member 13K from the photosensitive member 13C or corresponds to a setting that indicates how long a phase delay in the photosensitive member 13C with respect to the photosensitive member 13K is recovered. Here in step S301, in response to the performance of processing illustrated in FIGS. 17 and 18, which will be described below, and to changing of a relative phase difference between the photosensitive members 13C and 13K, the delay value Td is set on all such occasions.

FIG. 13 is a table indicating how long the photosensitive member 13C being at rest is delayed with respect to the photosensitive member 13K in combinations of the phase counter values Ccnt and Kcnt. The information indicated in FIG. 13 is stored in a storage portion (not shown) within the main body of the color image forming apparatus in the form allowing the control unit 41 to refer to the information.

In an activation process in color printing illustrated in FIG. 6, the phase counter values Ccnt=2 and Kcnt=1 in print stand-by state. According to FIG. 13, the photosensitive member 13C is at rest with a delay phase difference of 240 degrees with respect to the photosensitive member 13K. That is, the delay value Td is set such that this phase difference of 240 degrees is cancelled when both of the photosensitive members 13C and 13K are in a steady rotation. When the phase difference is 0 degrees, it can be assumed that the delay phase difference is 360 degrees.

The delay value Td are described below in further detail. As a precondition, each of an accelerating curve before the photosensitive member 13C reaches its steady rotation and that before the photosensitive member 13K reaches its steady rotation is determined in advance in itself, and the time from the photosensitive member is activated to when the photosensitive member reaches its steady rotation is also determined in advance. That is, activation of the photosensitive member 13K after a delay of the delay value Td means that the photosensitive member 13C is rotated at a predetermined rotation speed by a time of Td longer, compared with the photosensitive member 13K.

More specifically, when Ccnt=2 and Kcnt=1, as described above, where the time required for one steady rotation of each of the photosensitive members (13Y, 13M, 13C, and 13K) in printing is Tr, the delay value Td is Tr×240 (deg)/360 (deg). If this time is insufficient to prevent the starting currents of the motors 32C and 32K from overlapping, the delay value Td may be Tr×(N+240 (deg)/360 (deg)) (N is an integer). Where the phase difference between the photosensitive members 13C and 13K is θ, the delay value Td can be generalized as the following expression using the above-described Tr.

$$Td=Tr\times(N+(\theta(\text{deg})/360\ (\text{deg}))\ (N \text{ is a positive integer})$$

According to the table of FIG. 13, the phase difference between the photosensitive members 13C and 13K has three levels. That is, there are three levels in the degree of a delay in the photosensitive member 13C with respect to the photosensitive member 13K, and in response to an interruption caused by a deactivation process in monochrome printing illustrated in FIG. 8, the value of Td is changed in sequence by the control unit 41. As previously described, in step S301, on all such occasions, the value of Td is set so as to correspond to the combination of Ccnt and Kcnt in accordance with the table of FIG. 13.

Referring back to the flowchart of FIG. 12, in step S302, driving of the motor 32C for driving the photosensitive member 13C is started. In response to this, the rotation of the photosensitive member 13C is activated.

In steps S304 and S305, Ccnt is updated. More specifically, in step S303, when Ccnt=2, Ccnt becomes zero in step S304; when Ccnt≠2, Ccnt is incremented in step S305. Here in one example, because Ccnt=2, Ccnt becomes zero in step S304, and flow proceeds to step S306.

In step S306, the general-purpose timer T is started. In step S307, the timer value T is compared with the delay value Td. The delay value Td in step S307 is set such that a phase relationship at which color shift is small can be quickly established in response to activation of both of the photosensitive members 13C and 13K. The delay value Td may be set such that a phase relationship at which color shift is small can be established when both of the photosensitive members are driven at a constant speed, or alternatively, may be set such that a phase relationship at which color shift is small can be established at the earliest time during activation (acceleration).

Referring back to the flowchart of FIG. 12, when the value of the general-purpose timer T is equal to or larger than Td (YES in step S307), flow proceeds to step S308, where the motor 32K for driving photosensitive member 13K having been waiting for activation is started. Because the driving of the motor 32K for driving photosensitive member 13K is started after a wait of the delay value Td, an overlap of peak currents can be prevented.

In steps S310 and S311, Kcnt is updated. More specifically, in step S309, when Kcnt=2, Kcnt becomes zero in step S310; when Kcnt≠2, Kcnt is incremented in step S311. In the example illustrated in FIG. 6, because Kcnt=1 in an activation process in color printing, Kcnt is incremented and becomes two in step S311, and flow proceeds to step S312.

In step S312, it is determined whether the motor 32C for driving the photosensitive member 13C reaches a predetermined speed and is driven at a constant speed, in other words, whether the photosensitive member 13C is in a steady rotation.

When the photosensitive member 13C is driven at a constant speed (YES in step S312), flow then proceeds to step S313, where it is determined whether the motor 32K for driving photosensitive member 13K is driven at a constant speed. When the motor 32K for driving photosensitive member 13K is also driven at a constant speed (YES in step S313), full-color printing is started.

In actuality, although not illustrated, like in an activation process in initialization, after fine-adjustment phase correction for the photosensitive members 13C and 13K is performed again to enhance accuracy, full-color printing is started. By a wait of a time of the delay value Td in step S307, control is already performed in which the phase difference between the photosensitive members 13C and 13K has a predetermined phase difference relationship at which AC-component color shift is reduced. Accordingly, compared with when control including a wait in an activation process illustrated in this flowchart is not performed, not much time is required for phase correction control between photosensitive members performed after step S313.

When the full-color printing is completed, a deactivation process in full-color printing is performed in accordance with the flowchart for the deactivation process in initialization and full-color printing illustrated in FIG. 11.

As described above, according to the flowchart of FIG. 12, the motor 32K for driving photosensitive member 13K is activated with a time lag after the activation of the motor 32C for driving the photosensitive member 13C. Accordingly, an overlap of starting currents of the motors 32 can be prevented. Therefore, the capacity of the power supply can be reduced.

Additionally, because the delay value Td is set in consideration of the phase difference between the photosensitive members 13C and 13K before their activation, the phase relationship between rotary members can be quickly made to a desired phase relationship after activation while at the same time local abrasion and an overlap of starting current peaks can be prevented.

Activating and deactivating the photosensitive members (13Y, 13M, and 13C) and the photosensitive member 13K in the order of image forming can make abrasion of the photosensitive members (13Y, 13M, 13C, and 13K) uniform, thus resulting in an increased life of the entire apparatus.

Detecting a phase and deactivating the motor 32C for driving the photosensitive member 13C and the motor 32K for driving photosensitive member 13K after driving the motor 32C for driving the photosensitive member 13C and the motor 32K for driving photosensitive member 13K at a low speed enables the photosensitive members to stop at a predetermined phase with high accuracy.

Because of a wait in step S307, in the case where fine-adjustment phase correction is performed after the motor 32K for driving photosensitive member 13K is driven at a constant speed, a time required for the phase correction can be smaller, compared with when the phases of the photosensitive members 13C and 13K do not match at all. That is, the processing of step S307 enables the phase difference between the first and second rotary members to be quickly set at a predetermined phase difference at which color shift is small.

Description in Monochrome Printing

An operation in monochrome printing, in which the photosensitive members for use in color printing (13Y, 13M, and 13C) are not driven (not used), will now be described below with reference to FIGS. 14, 15, 16, 17, and 18. First, an activation process in monochrome printing (mono-color printing) is described with reference to FIGS. 14, 15, and 17.

Values of Phase Counters 44C and 44K in States

FIG. 14 illustrates the values of the phase counters 44C and 44K in states. Ccnt and Kcnt are described above with reference to FIG. 6.

Figure 15:
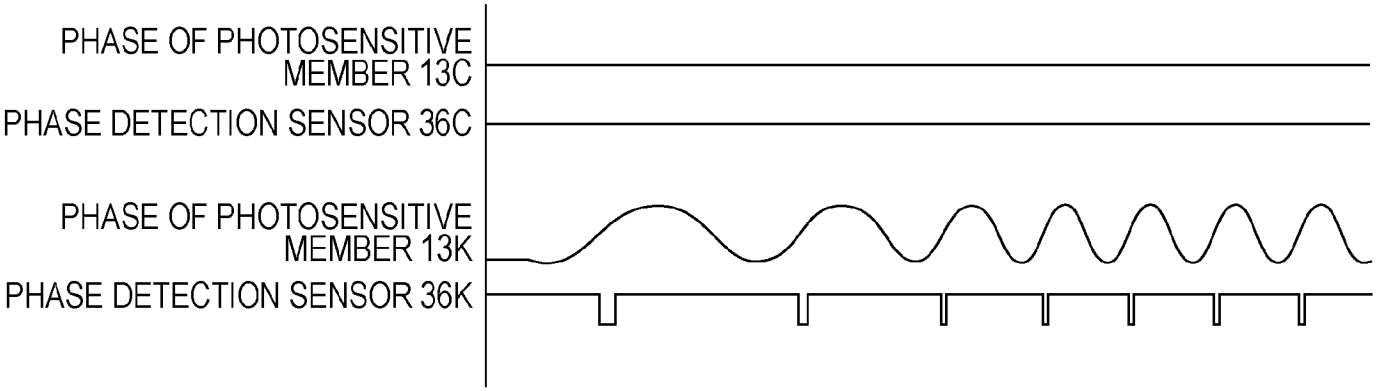
FIG. 15 illustrates how a phase relationship between photosensitive members in a process for activating a photosensitive member in monochrome printing is changed according to one embodiment of the present invention.

FIG. 15 illustrates the phase of each of the photosensitive members 13K and 13C and the output of each of the phase detection sensors 36K and 36C therefor in an activation process in monochrome printing. In monochrome printing, the photosensitive member 13C is separated from the intermediate transfer belt 17, is not used in image formation, and is not rotated. Accordingly, there is no detection signal of the phase detection sensor 36C.

Flowchart of Activation Process in Monochrome Printing

Figure 17:
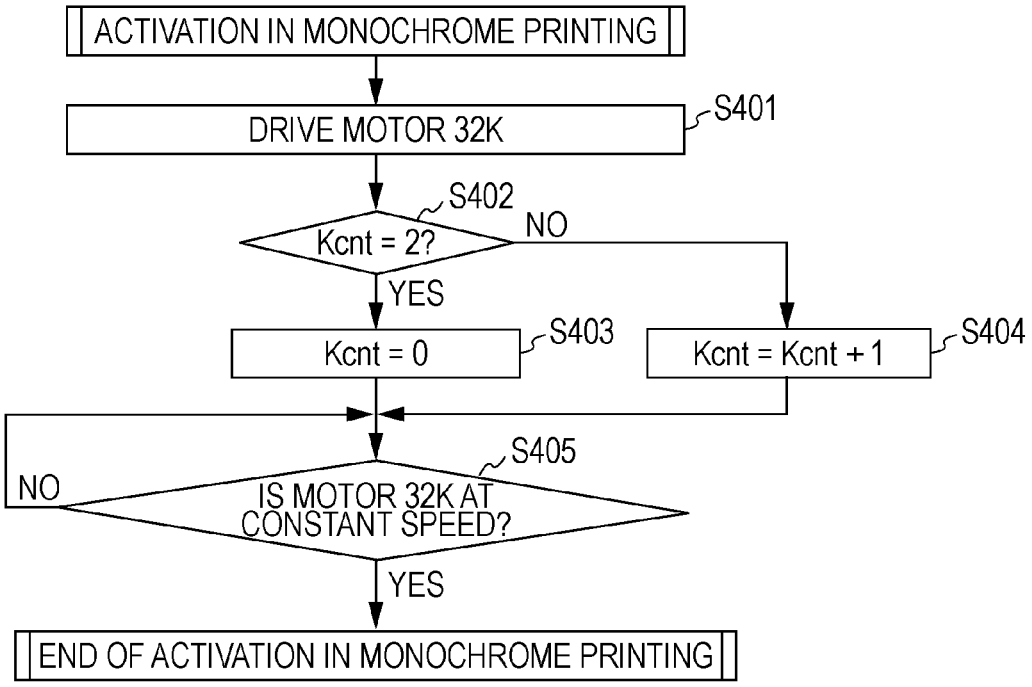
FIG. 17 is a flowchart of a process for activating a photosensitive member in monochrome printing according to one embodiment of the present invention.

FIG. 17 is a flowchart of an activation process in monochrome printing. The steps of this flowchart are executed based on the processing of the control unit 41 illustrated in FIG. 5. The details are described below.

When the activation process in monochrome printing starts, in step S401, driving of the motor 32K for driving photosensitive member 13K starts.

Then, in step S402, when Kcnt=2, flow proceeds to step S403, where Kcnt becomes zero; when Kcnt≠2, flow proceeds to step S404, where Kcnt is incremented. Here, according to FIG. 14, because Kcnt=2 in monochrome printing, Kcnt becomes zero in step S403, and flow proceeds to step S405.

In step S405, it is determined whether the motor 32K for driving photosensitive member 13K reaches a predetermined speed and is driven at a constant speed. When the motor 32K for driving photosensitive member 13K is driven at a constant speed (YES in step S405), monochrome printing starts. At this time, the photosensitive member 13C is not activated. Therefore, the phase counter 44C for the photosensitive member 13C remains unchanged and Ccnt remains zero.

As described above, in mono-color printing, the photosensitive member 13C is not rotated and not used. Therefore, according to the flowchart of FIG. 17, only Kcnt is updated. When the flowchart of FIG. 18, which will be described below, is subsequently performed, only the stop position of the photosensitive member 13K differs from the preceding stop position. Therefore, a relative phase difference between the photosensitive members 13C and 13K when they are at rest is changed. In response to the change in the relative phase difference, the value of Td set in step S301 illustrated in FIG. 12, which is described above, is also changed to an appropriate value.

Flowchart of Deactivation Process in Monochrome Printing

Figure 16:
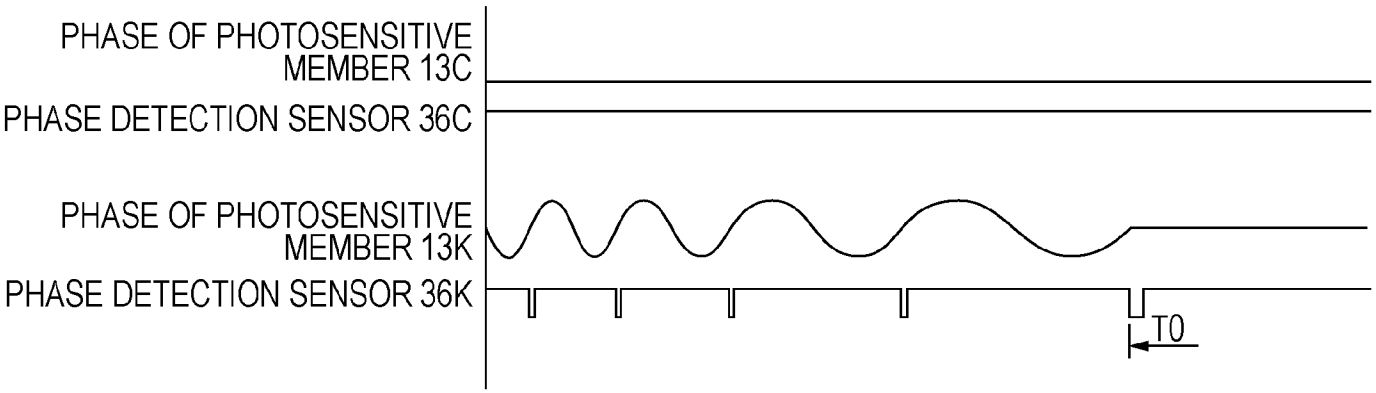
FIG. 16 illustrates how a phase relationship between photosensitive members in a process for deactivating a photosensitive member in monochrome printing is changed according to one embodiment of the present invention.

A deactivation process in monochrome printing will now be described below with reference to FIGS. 14, 16, and 18. FIG. 16 illustrates the phase of each of the photosensitive members 13K and 13C and the output of each of the phase detection sensors 36K and 36C therefor in a deactivation process in monochrome printing. In monochrome printing, the photosensitive members 13C, 13M, and 13Y are separated from the intermediate transfer belt 17, are not used in image formation, and are not rotated. At this time, in the case of an image forming system in which a toner image is directly transferred from a photosensitive drum to a sheet, the photosensitive members 13C, 13M, and 13Y can be separated from the sheet conveying belt.

Figure 18:
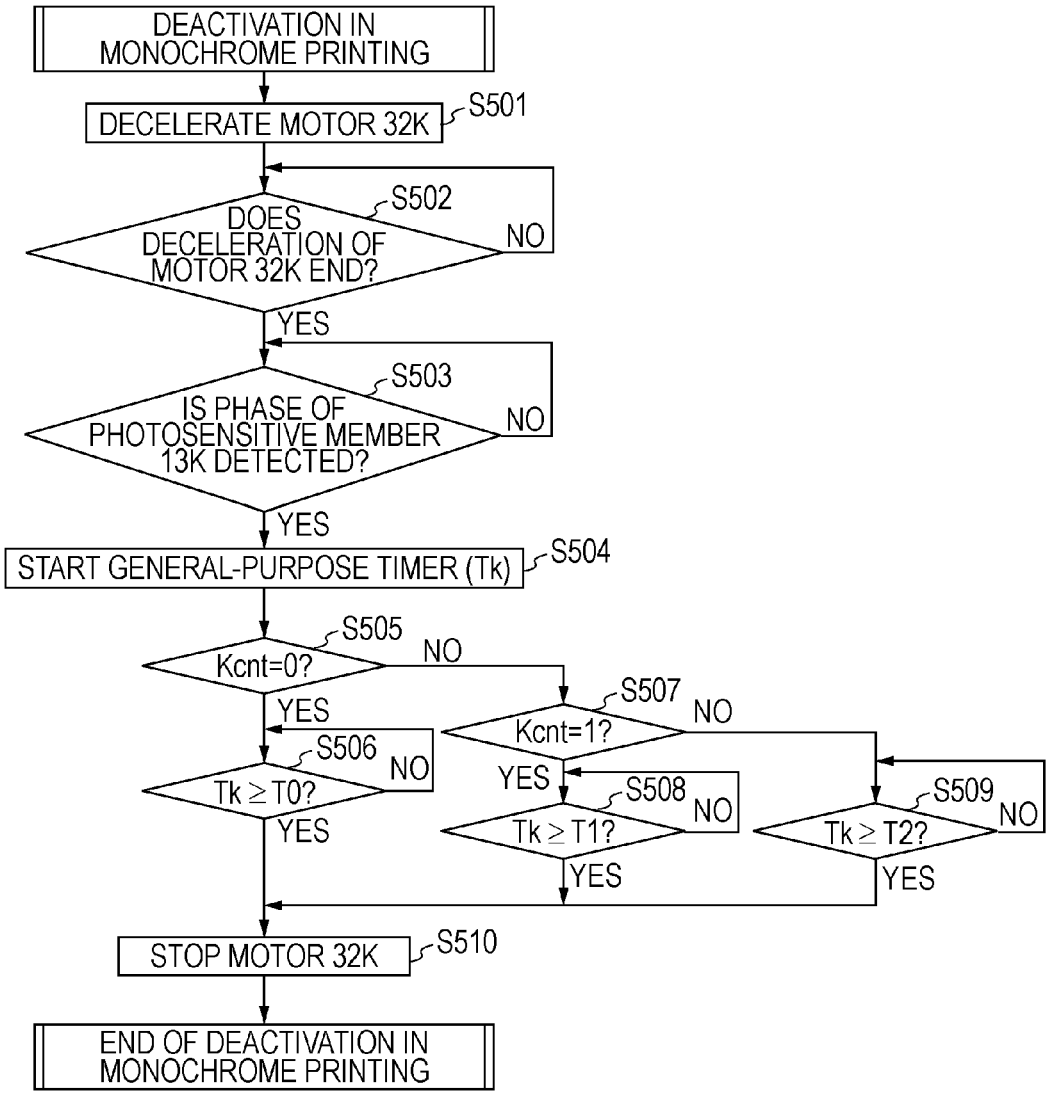
FIG. 18 is a flowchart of a process for deactivating a photosensitive member in monochrome printing according to one embodiment of the present invention.

FIG. 18 is a flowchart of a deactivation process in monochrome printing. The steps of this flowchart are executed based on the processing of the control unit 41 illustrated in FIG. 5. The details are described below.

When the deactivation process in monochrome printing starts, in step S501, the motor 32K for driving the photosensitive member 13K is decelerated.

Then, in step S502, it is determined whether the deceleration of the motor 32K for driving the photosensitive member 13K is completed. When the deceleration is completed (YES in step S502), flow proceeds to step S503.

In step S503, the phase of the photosensitive member 13K is detected. When the phase detection sensor 36K for the photosensitive member 13K detects the slit 35K, the general-purpose timer Tk is started in step S504.

In step S505, the value of the phase counter 44K is checked. When Kcnt=0, flow proceeds to step S506; when Kcnt≠0, flow proceeds to step S507. In step S507, when Kcnt=1, flow proceeds to step S508; when Kcnt≠1, flow proceeds to step S509.

In steps S506, S508, and S509, when the value of the general-purpose timer Tk is compared with predetermined values T0, T1, and T2, respectively. When Tk≧T0, TK≧T1, and Tk≧T2 in steps S506, S508, and S509, respectively, the motor 32K for driving the photosensitive member 13K is stopped in step S510. Through this processing, when the mono-color printing using black alone (referred to also as black mono-color printing) is completed, control in deactivation can be achieved in which the photosensitive member 13K stops at a position different from the preceding stop position. Also in continuous monochrome printing, the photosensitive member 13K can be prevented from local abrasion.

The above description can apply to T0, T1, and T2. According to FIG. 14, because Kcnt=0 as one example, the motor 32K for driving photosensitive member 13K stops through step S506. In such a way, the deactivation process in monochrome printing is completed, and the state shifts to a print stand-by state.

In the case where full-color printing is performed next, the delay value Td in the flowchart of FIG. 12 can be set such that the phase difference between the photosensitive members corresponding to the combination of Ccnt and Kcnt illustrated in FIG. 14 (in FIG. 14, Ccnt=0 and Kcnt=0 in a stand-by state) is cancelled. In FIG. 14, because Ccnt and Kcnt have a combination of Ccnt=0 and Kcnt=0 in a stand-by state, the relative phase difference between the photosensitive members when they are at rest is 0 degrees (360 (deg)×N (N is a positive integer)) according to FIG. 13. The flowchart of FIG. 12 is performed such that this relative phase difference is cancelled. A detailed operation of this is previously described in a deactivation process in full-color printing, so the description is not repeated here.

Advantages in First Exemplary Embodiment

As described above, also in black continuous monochrome printing, the rotary member and the gear for driving the rotary member can be protected against local abrasion, an overlap of starting current peaks of the motor for driving each of the rotary members can be prevented, and the phase relationship between the rotary members can be quickly made to a desired phase relationship. The predetermined phase relationship used here indicates the phase difference between the first rotary member (photosensitive member 13C) and the second rotary member (photosensitive member 13K) at which color shift is reduced. Being the phase difference includes substantially being the phase difference, as described above.

In the color image forming apparatus, it is observed that approximately 420 ms is required for one rotation of each of the photosensitive member and that, when phase correction control is carried out after each of the photosensitive members is driven at a constant speed in accordance with the flowchart of FIG. 12, approximately 1 second is required at maximum.

When the image forming apparatus having motor specifications and power-supply capacity at this time performs known phase correction control without performing the flowchart illustrated in FIG. 12, it is observed that 2.5 seconds are required for the phase correction control at maximum when the photosensitive members are activated such that the phase relationship therebetween is in a random fashion and, after each of the photosensitive members (motors 32) is driven at a constant speed, the phase difference between the photosensitive members is made to a desired phase difference.

That is, it is observed that the phase relationship between the rotary members can be quickly corrected to a relationship at which color shift is small by the processing according to the present exemplary embodiment.

If the power-supply capacity is increased and the accelerating performance of the motor 32 is enhanced, the time for activation containing phase correction control can be reduced to some extent. However, in actuality, from cost, space, and other factors, the power-supply capacity may have to be limited. In such cases, the processing described above in the first exemplary embodiment is significantly effective.

A second exemplary embodiment will be described as follows. In the first exemplary embodiment, a case where, when full-color printing is completed, the photosensitive members 13C and 13K are stopped with a relative phase difference of 240 degrees (non-zero phase difference) is described as one specific example. In the second exemplary embodiment, in an activation process in full-color printing, the photosensitive members 13C and 13K have no relative phase difference (0 degrees). This activation process in full-color printing will now be described with reference to FIGS. 13, 14, and 19. The present exemplary embodiment is another specific embodiment and further enhances the first exemplary embodiment.

Values of Phase Counters 44C and 44K in States

Figure 19:
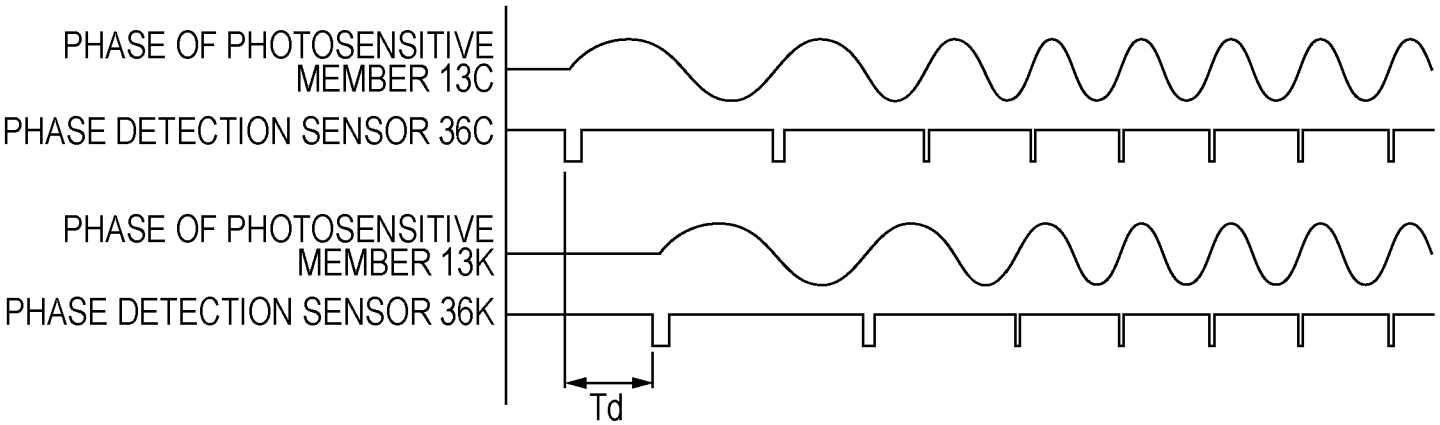
FIG. 19 illustrates how a phase relationship between photosensitive members in a process for activating photosensitive members in full-color printing is changed according to one embodiment of the present invention.

FIG. 19 illustrates the phase of each of the photosensitive members 13K and 13C and the output of each of the phase detection sensors 36K and 36C therefor in an activation process when there is no phase difference between the photosensitive members 13K and 13C in full-color printing.

The values of the phase counters after monochrome printing described with reference to FIG. 14 in the above exemplary embodiment are that Ccnt=0 and Kcnt=0. According to FIG. 13, the photosensitive members 13C and 13K are at rest with no phase difference. This activation process in full-color printing is performed in accordance with the flowchart of FIG. 12, which is described in the first exemplary embodiment.

First, in step S301, the delay value Td is set. In FIG. 14, the phase counter values in a print stand-by state are that Ccnt=0 and Kcnt=0 and there is no phase difference between the photosensitive members 13C and 13K. Therefore, the delay value Td at which the phase difference is cancelled is zero. However, if the delay value Td=0, the motor 32K for driving photosensitive member 13K is driven simultaneously, this results in an overlap of starting currents of the motors 32C and 32K, and a large current undesirably passes through the power supply. Accordingly, without simultaneous activation of the motors 32C and 32K, a delay corresponding to N periods of the photosensitive member 13, i.e., 360×N degrees is provided in activating the motor 32C for driving the photosensitive member 13C.

More specifically, where the time required for one rotation of the photosensitive member 13 in printing is Tr, the delay value Td is Tr×N (N is a positive integer). The subsequent steps in the flowchart illustrated in FIG. 12 are substantially the same as in the first exemplary embodiment, so the description is not repeated here.

As described above, even when there is no phase difference between the photosensitive members 13C and 13K, an overlap of starting currents of the motor 32C for driving the photosensitive member 13C and the motor 32K for driving photosensitive member 13K can be prevented by a shift of 360×N degrees in activation timing. Other advantages are substantially the same as in the above exemplary embodiment.

A third exemplary embodiment will be described as follows. In the present exemplary embodiment, a case where the photosensitive members (13Y, 13M, 13C, and 13K) are driven by independent motors 32 is described. Even with a system in which the photosensitive members (13Y, 13M, 13C, and 13K) are driven by independent motors, the advantages described in the above exemplary embodiments are obtainable by replacement of the motor 32C for driving the photosensitive member 13C described in the above exemplary embodiments with three motors for driving the photosensitive members for use in color printing. However, simultaneous driving of the three motors for driving the photosensitive members for use in color printing may cause a concern of an overlap of starting currents of these three motors. A method for avoiding such an overlap of starting currents is described below.

Figure 20:
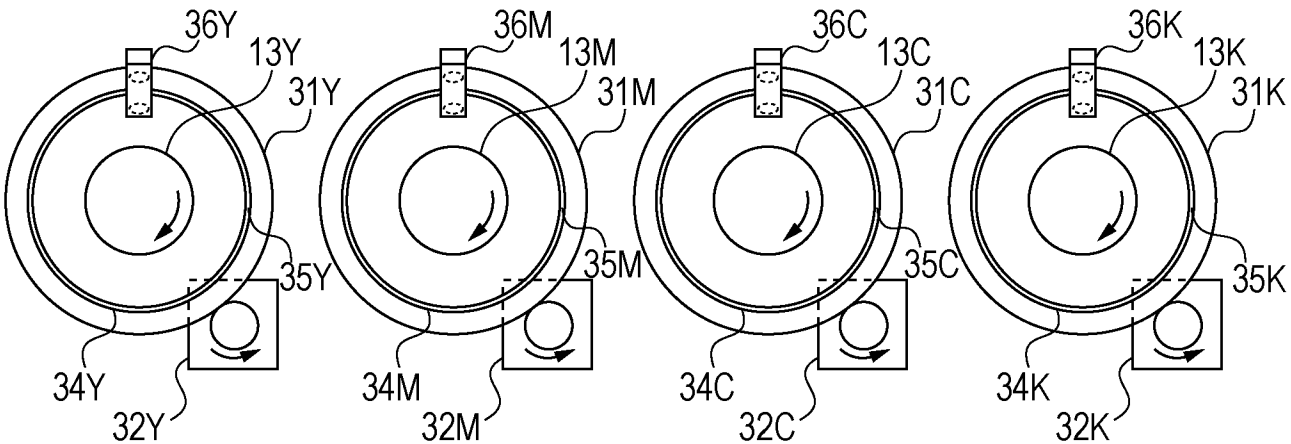
FIG. 20 illustrates a configuration of a driving unit for photosensitive members according to one embodiment of the present invention.

First, a structure for driving the photosensitive members according to the present exemplary embodiment is described with reference to FIG. 20. In FIG. 20, the photosensitive members (13Y, 13M, 13C, and 13K) and the photosensitive-member gears (31Y, 31M, 31C, and 31K) are connected, respectively, by a coupling (not shown) such that they always have the same phase relationship.

The photosensitive-member gears (31Y, 31M, 31C, and 31K) are connected to motors (32Y, 32M, 32C, and 32K) for driving the photosensitive members (13Y, 13M, 13C, and 13K), respectively. The photosensitive-member gears (31Y, 31M, 31C, and 31K), slit plates (34Y, 34M, 34C, and 34K), slits (35Y, 35M, 35C, and 35K), and phase detection sensors (36Y, 36M, 36C and 36K) have substantially the same structure as in the first exemplary embodiment. The photosensitive-member gears (31Y, 31M, 31C, and 31K) and the slits (35Y, 35M, 35C, and 35K) have the same phase relationship, as in the first exemplary embodiment.

Figures 21, 22:
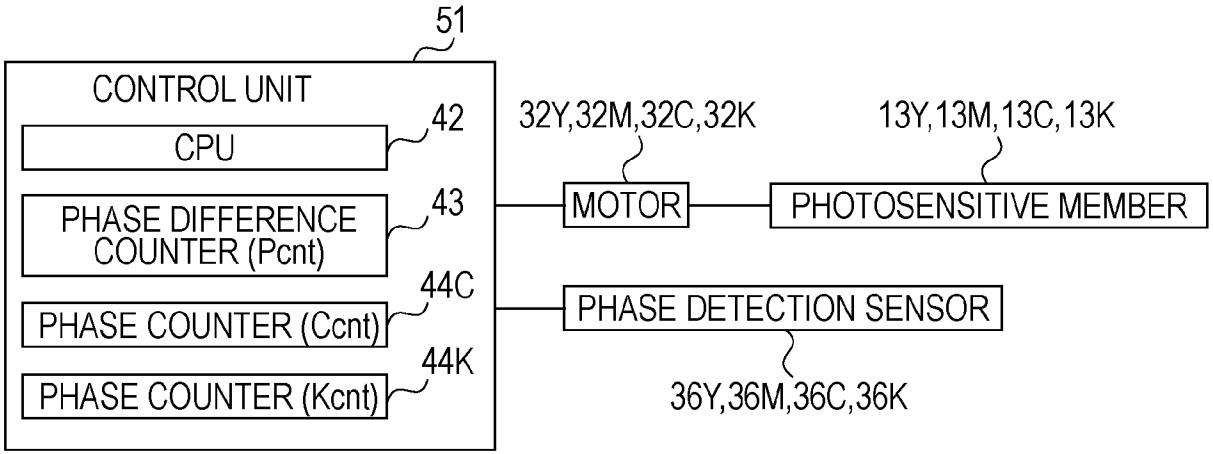
FIG. 21 is a block diagram of a control configuration according to one embodiment of the present invention.
FIG. 22 illustrates how a phase counter value is changed according to one embodiment of the present invention.

FIG. 21 is a block diagram of a control configuration according to the present exemplary embodiment. A control unit 51 includes a CPU 42, a phase difference counter 43, a phase counter 44C, and a phase counter 44K. The control unit 51 is connected to the motors (32Y, 32M, 32C, and 32K) for driving the photosensitive members (13Y, 13M, 13C, and 13K) and the phase detection sensors (36Y, 36M, 36C, and 36K). The phase counter 44C is a common counter for use in the photosensitive members for use in full-color printing (13Y, 13M, and 13C). Other structures are substantially the same as in the control configuration diagram described in the first exemplary embodiment, so the description is not repeated here.

Figure 23:
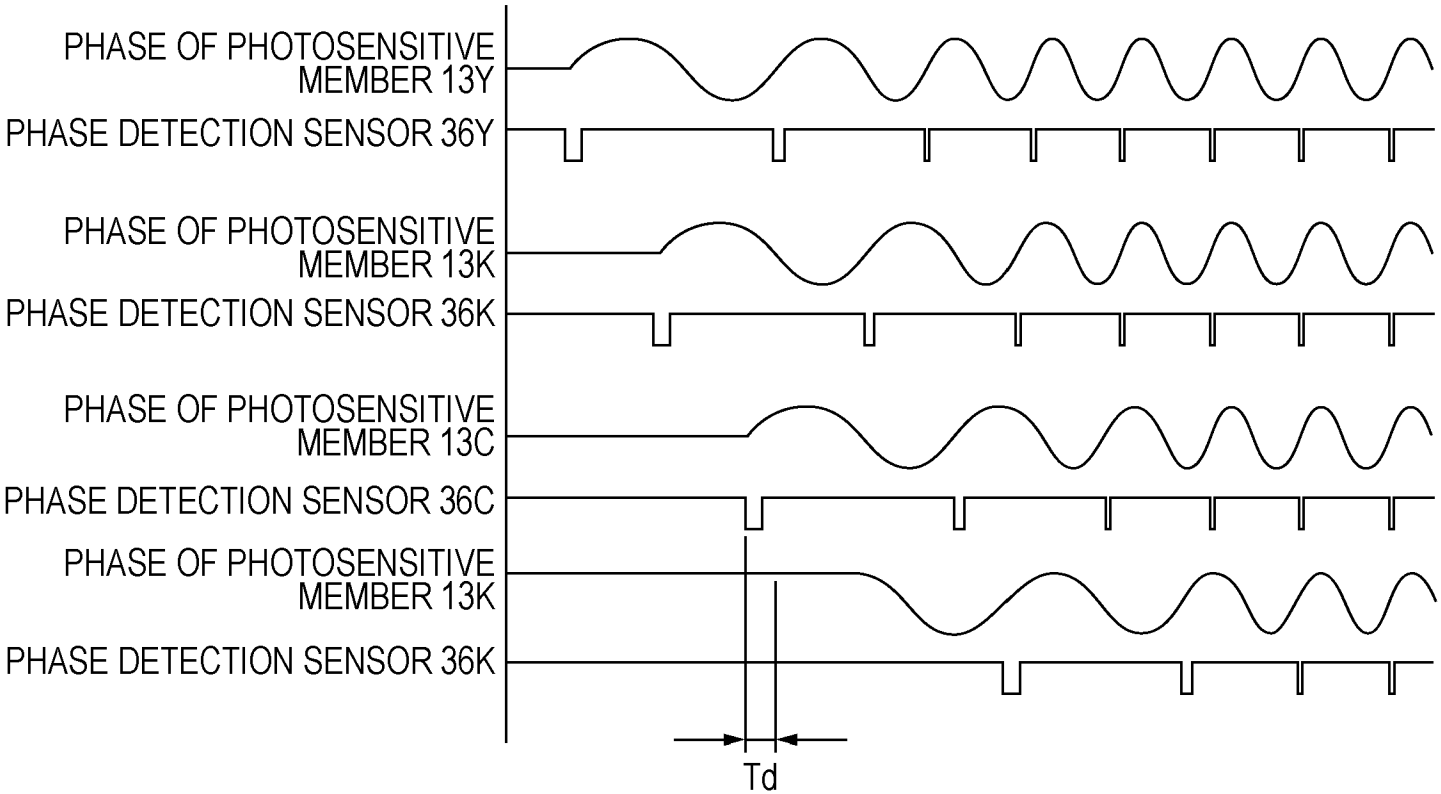
FIG. 23 illustrates how a phase relationship between photosensitive members in a process for activating photosensitive members in full-color printing is changed according to one embodiment of the present invention.

An operation according to the present exemplary embodiment will now be described below with reference to FIGS. 22 to 24.

An activation process in initialization is the process in which the operations of steps S101 and S102 illustrated in FIG. 10 in the first exemplary embodiment for the motors 32Y and 32M are merely added. The detailed description is not repeated here. A deactivation process is the process in which the operations of step S203 and steps S205 to S212 for the motors 32Y and 32M are merely added. The detailed description is not repeated here. An activation process and deactivation process in monochrome printing are also substantially the same as in the first exemplary embodiment, so the description is not repeated here. Thus, only an activation process in full-color printing is described below.

Values of Phase Counters 44C and 44K in States

FIG. 22 illustrates the values of the phase counters 44C and 44K in states. FIG. 23 illustrates the phase of each of the photosensitive members (13Y, 13M, 13C, and 13K) and the output of each of the phase detection sensors (36Y, 36M, 36C, and 36K) therefor in an activation process in full-color printing.

Figure 24:
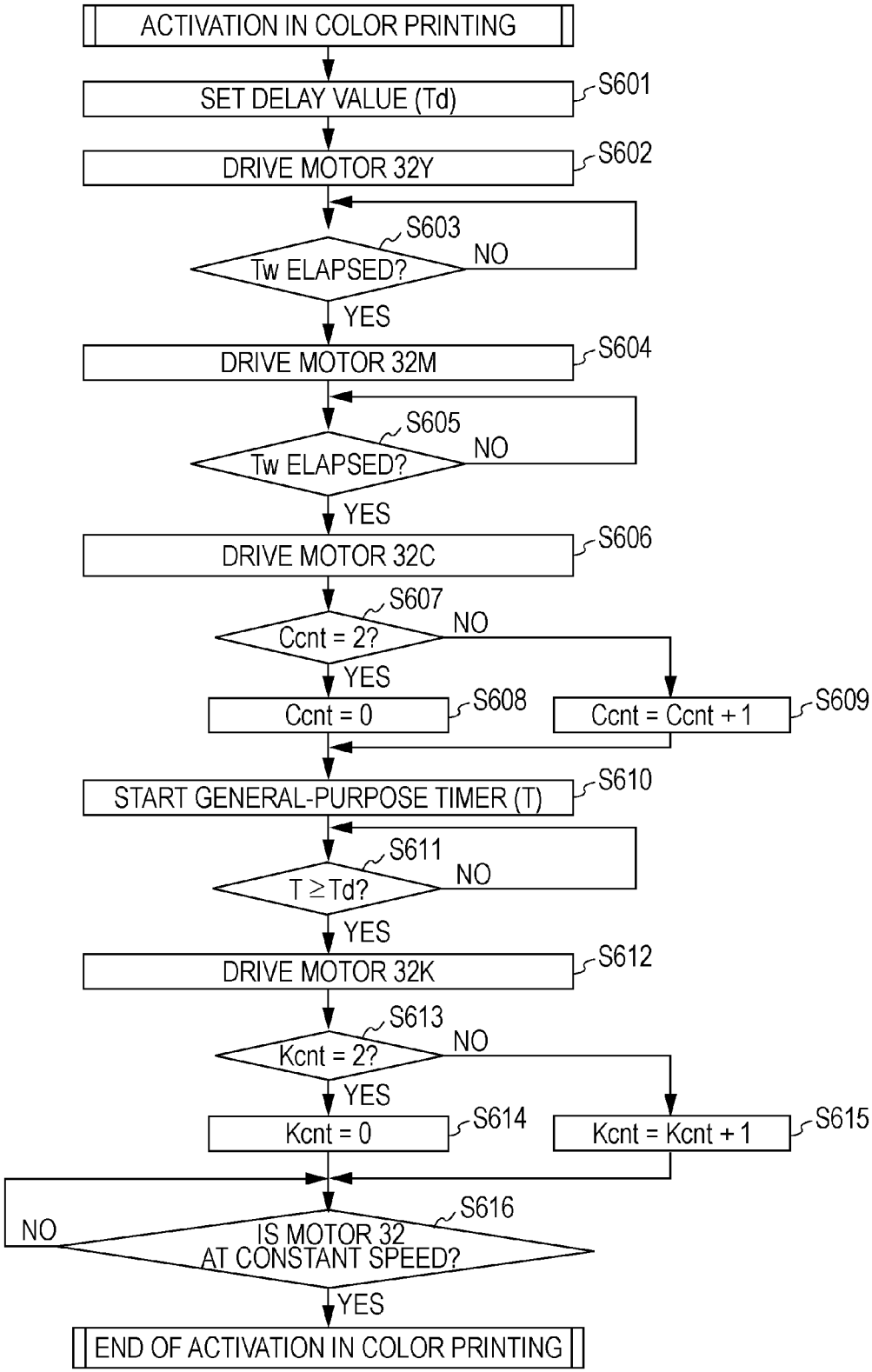
FIG. 24 is a flowchart of a process for activating photosensitive members in full-color printing is changed according to one embodiment of the present invention.

FIG. 24 is a flowchart of the activation process in full-color printing. The steps of this flowchart are executed based on the processing of the control unit 51 illustrated in FIG. 21. The details are described below.

When the activation process in full-color printing starts, in step S601, the delay value Td is set.

In FIG. 22, the values of the phase counters in a print stand-by state are that Ccnt=0 and Kcnt=2. According to FIG. 13, the photosensitive member 13K is at rest with a delay phase difference of 120 degrees with respect to the photosensitive members (13Y, 13M, and 13C). The delay value Td at which this phase difference of 120 degrees is cancelled is set.

More specifically, where the time required for one rotation of the each of the photosensitive members (13Y, 13M, 13C, and 13K) in printing is Tr, the delay value Td is Tr×120 (deg)/360 (deg). If this time is insufficient to avoid the starting currents of the motors 32C and 32K from overlapping, the delay value Td may be Tr×(N+120 (deg)/360 (deg)) (N is a positive integer).

In step S602, driving the motor 32Y for driving the photosensitive member 13Y is started. In step S603, after a wait time Tw elapses, flow proceeds to step S604. The wait time Tw is Tr×N (N is a positive integer), where Tr is the time required for one rotation of the photosensitive member 13 in printing.

Similarly, in step S604, driving of the motor 32M for driving the photosensitive member 13M is started. In step S605, after the wait time Tw elapses, flow proceeds to step S606, where the motor 32C for driving the photosensitive member 13C is driven. In such a way, a plurality of rotary members are sequentially activated one by one after being rotated by 360×N degrees (N is a positive integer), and, after the last rotary member (photosensitive member 13C) is activated, the photosensitive member 13K is waited and activated.

Step S606 and its subsequent steps are basically the same as steps S303 and its subsequent steps illustrated in FIG. 12.

In step S607, when Ccnt=2, flow proceeds to step S608, where Ccnt becomes zero; when Ccnt≠2, flow proceeds to step S609, where Ccnt is incremented. Here, because Ccnt=0, Ccnt is incremented and becomes one in step S609, and flow proceeds to step S610.

In step S610, the general-purpose timer T is started. In step S611, the value of the general-purpose timer T is compared with the delay value Td. When the value of the general-purpose timer T is equal to or larger than the delay value Td (YES in step S611), flow proceeds to step S612, where driving of the motor 32K for driving the photosensitive member 13K is started.

Then, in step S613, when Kcnt=2, Kcnt becomes zero in step S614; when Kcnt≠2, Kcnt is incremented in step S615. Here, because Kcnt=2 as one example, Kcnt becomes zero in step S614, and flow proceeds to step S616.

In step S616, it is determined whether all of the motors (32Y, 32M, 32C, and 32K) for driving the photosensitive members (13Y, 13M, 13C, and 13K) reach a predetermined speed and are driven at a constant speed. When they are driven at a constant speed (YES in step S616), full-color printing is started. The full-color printing may be started after the phase between the photosensitive members 13C and 13K is matched again and the accuracy is increased, as in the case of step S114 illustrated in FIG. 10.

As described above, even when the photosensitive members (13Y, 13M, 13C, and 13K) are driven by the independent motors (32Y, 32M, 32C, and 32K), similar advantages to those in the first and second exemplary embodiments are obtainable.

A fourth exemplary embodiment will be described as follows. In the first and second exemplary embodiments, the four photosensitive members are driven using the two motors 32K and 32C. However, other driving may also be used. For example, the above exemplary embodiments are also applicable to a case where the photosensitive members for yellow and magenta are driven by a common motor, the photosensitive member for cyan is driven by a single motor, and the photosensitive member for black is driven by another single motor.

In this case, in the flowchart illustrated in FIG. 24, steps S602 and S603 can be skipped, the motor for driving the photosensitive members 13Y and 13M can be driven in step S604, and the motor for driving the photosensitive member 13C is driven in step S606.

Alternatively, the common motor for driving the photosensitive members for yellow and magenta and the motor for driving the photosensitive member for cyan may be driven simultaneously. The first and second exemplary embodiments are also applicable to this case.

OTHER EMBODIMENTS

In the above exemplary embodiments, after the photosensitive members for colors are activated, the photosensitive member for black is activated. However, other activation can also be used.

For example, the photosensitive members for colors may be activated after the photosensitive member for black is activated. In this case, in the flowcharts illustrated in FIGS. 10, 11, and 12 and the table illustrated in FIG. 13, the motors 32C and 32K are interchanged. In the flowcharts illustrated in FIGS. 17 and 18, the processing described in the above exemplary embodiments can be performed for the photosensitive member 13K for black.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-162300 filed Jun. 20, 2008, which is hereby incorporated by reference herein in its entirety.

What is claimed is:

1. A color image forming apparatus comprising:

a first rotary member configured to form a color toner image;

a second rotary member configured to form a black toner image;

wherein in black mono-color printing an image is formed using the second rotary member without use of the first rotary member, in full-color printing an image is formed using the first and second rotary members, and a phase difference between the first and second rotary members is adjusted to reduce color shift, a deactivation controller configured to stop the second rotary member after a current black mono-color printing is performed such that the phase difference, when the second rotary member is activated for the current black mono-color printing, is different from the phase difference based on a stop position of the second rotary member stopped by the deactivation controller and a stop position of the first rotary member; and an activation controller configured to, in full-color printing, activate one of the first and second rotary members with a time lag after the other of the first and second rotary members is activated such that the phase difference between the first and second rotary members is an adjusted phase difference, wherein the activation controller is configured to change the time lag in response to the phase difference between the first and second rotary members generated by performing the black mono-color printing being changed by control on stopping of the second rotary member performed by the deactivation controller.

2. The color image forming apparatus according to claim 1, wherein in deactivating the first and second rotary members from their driven states when full-color printing is completed, the deactivation controller is configured to stop each of the first and second rotary members at a position different from a preceding stop position while maintaining the phase difference between the first and second rotary members at a preceding phase difference when the first and second rotary members are at rest.

3. The color image forming apparatus according to claim 1, wherein the activation controller is configured to, in full-color printing, activate one of the first and second rotary members with the time lag after the other of the first and second rotary members is activated such that the phase difference is the adjusted phase difference when both of the first and second rotary members are in a steady rotation.

4. The color image forming apparatus according to claim 1, further comprising a phase correction controller configured to finely adjust the phase difference between the first and second rotary members to the adjusted phase difference in response to both of the first and second rotary members reaching a steady rotation.

5. The color image forming apparatus according to claim 1, wherein the activation controller is configured to activate one of the first and second rotary members with a further time lag corresponding to 360×N degrees (N is a positive integer) with respect to the other of the first and second rotary members.

6. The color image forming apparatus according to claim 1, wherein the first rotary member comprises a plurality of rotary members corresponding to color toner images of a plurality of colors, and the activation controller is configured to sequentially activate the plurality of rotary members one by one after rotation of 360×N degrees (N is a positive integer) and activate the second rotary member with a lag after the last one of the plurality of rotary members is activated.

7. A method for controlling a color image forming apparatus including a first rotary member configured to form a color toner image and a second rotary member configured to form a black toner image, the color image forming apparatus forming an image in black mono-color printing using the second rotary member without use of the first rotary member and forming an image in full-color printing using the first and second rotary members, a phase difference between the first and second rotary members being adjusted to reduce color shift, the method comprising:

a deactivation controlling step of stopping the second rotary member after a current black mono-color printing is performed such that the phase difference, when the second rotary member is activated for the current black mono-color printing, is different from the phase difference between the first and second rotary members based on a stop position of the second rotary member stopped by the deactivation controlling step and a stop position of the first rotary member; and an activation controlling step of, in full-color printing, activating one of the first and second rotary members with a time lag after the other of the first and second rotary members is activated such that the phase difference between the first and second rotary members is an adjusted phase difference, wherein, in the activation controlling step, the time lag is changed in response to the phase difference between the first and second rotary members generated by performing the black mono-color printing being changed by control on stopping of the second rotary member performed in the deactivation controlling step.

8. The color image forming apparatus according to claim 1, wherein the second rotary member is stopped at the position different from the preceding stop position regardless of a position where the first rotary member is stopped.

9. An image forming apparatus comprising:

a first rotary member configured to form a color toner image;

a second rotary member configured to form a black toner image;

a deactivation controller configured to stop the second rotary member after a current black mono-color printing is performed such that a phase difference between the first and second rotary members, when the second rotary member is activated for the current black mono-color printing, is different from the phase difference between the first and second rotary members based on a stop position of the second rotary member stopped by the deactivation controller and a stop position of the first rotary member; and an activation controller configured to control rotation of the first rotary member and rotation of the second rotary member such that the phase difference generated by performing the black mono-color printing is adjusted.

10. The image forming apparatus according to claim 9, wherein, after one of the first rotary member and the second rotary member is activated, timing at which the other of the first rotary member and the second rotary member is activated is changed according to the phase difference.

* * * * *